US011220365B2

(12) United States Patent
Vine

(10) Patent No.: US 11,220,365 B2
(45) Date of Patent: Jan. 11, 2022

(54) PACKAGING SYSTEM AND METHOD

(71) Applicant: ISHIDA EUROPE LIMITED, Birmingham (GB)

(72) Inventor: Lee Vine, Lytchett Matravers (GB)

(73) Assignee: ISHIDA EUROPE LIMITED, Birmingham (GB)

( * ) Notice: Subject to any disclaimer, the term of this patent is extended or adjusted under 35 U.S.C. 154(b) by 118 days.

(21) Appl. No.: 16/609,701

(22) PCT Filed: Apr. 30, 2018

(86) PCT No.: PCT/GB2018/051146
§ 371 (c)(1),
(2) Date: Oct. 30, 2019

(87) PCT Pub. No.: WO2018/203042
PCT Pub. Date: Nov. 8, 2018

(65) Prior Publication Data

US 2020/0062435 A1 Feb. 27, 2020

(30) Foreign Application Priority Data

May 2, 2017 (GB) ..... 1706960

(51) Int. Cl.
*B65B 59/04* (2006.01)
*B65B 1/02* (2006.01)
(Continued)

(52) U.S. Cl.
CPC ..... *B65B 59/04* (2013.01); *B65B 1/02* (2013.01); *B65B 1/12* (2013.01); *B65B 1/32* (2013.01);
(Continued)

(58) Field of Classification Search
CPC .... B65B 1/12; B65B 1/02; B65B 1/32; B65B 1/36; B65B 65/003; B65B 65/00;
(Continued)

(56) References Cited

U.S. PATENT DOCUMENTS 5,288,200 A * 2/1994 Burgers ..... B65G 65/23 187/283
6,962,271 B2 11/2005 Gregson, Jr.
(Continued)

FOREIGN PATENT DOCUMENTS

CN 203854869 U 10/2014
CN 104379472 A 2/2015
(Continued)

OTHER PUBLICATIONS

International Search Report dated Sep. 24, 2018, in International Patent Application No. PCT/GB2018/051146, 5 pages.
(Continued)

*Primary Examiner* — Thomas M Wittenschlaeger
(74) *Attorney, Agent, or Firm* — Squire Patton Boggs (US) LLP

(57) ABSTRACT

There is provided a lifting apparatus (16) comprising a lifting frame (16*a*) configured to be mechanically coupled to a packaging machine (12), and configured to couple with a feed device (14), wherein the lifting frame (16*a*) is configured to translate, raise and lower the feed device (14) relative to the packaging machine (12), and a packaging system comprising a packaging machine (12) with said lifting apparatus (16) wherein said packaging machine (12) is configured to detachably couple to a feed device (14), wherein the mass of the packaging machine (12) acts to counterbalance at least a portion of the mass of the feed device (14) whilst the feed device (14) is being translated, raised or lowered relative to the packaging machine (12).
(Continued)

There is further provided methods of operating said packaging system for installing to and removing from the packaging machine (12) the feed device (14).

20 Claims, 10 Drawing Sheets

(51) Int. Cl.

| | |
|---|---|
| ***B65B 1/12*** | (2006.01) |
| ***B65B 1/32*** | (2006.01) |
| ***B65B 1/36*** | (2006.01) |
| ***B65B 65/00*** | (2006.01) |
| ***B65B 3/28*** | (2006.01) |
| ***B65B 3/30*** | (2006.01) |

(52) U.S. Cl.
CPC ..... *B65B 1/36* (2013.01); *B65B 3/28* (2013.01); *B65B 3/30* (2013.01); *B65B 65/00* (2013.01); *B65B 65/003* (2013.01)

(58) Field of Classification Search
CPC .. B65B 3/28; B65B 3/30; B65B 59/04; B65B 37/00; B65B 37/02; B65B 39/00; B65B 39/007; B65B 39/02; B65B 9/20; B66C 23/72
USPC ..... 53/541, 551, 393; 141/231, 232, 233, 141/284, 379
See application file for complete search history.

(56) References Cited

U.S. PATENT DOCUMENTS

| | | | | |
|---|---|---|---|---|
| 8,468,781 | B2 * | 6/2013 | Fritzsche | B65G 57/035 53/447 |
| 2005/0115982 | A1 | 6/2005 | Gregson, Jr. | |
| 2010/0146907 | A1 | 6/2010 | Fritzsche et al. | |
| 2012/0207566 | A1 | 8/2012 | Maile | |

FOREIGN PATENT DOCUMENTS

| | | | |
|---|---|---|---|
| CN | 205254990 | U | 5/2016 |
| DE | 10 2011 087 502 | A1 | 6/2013 |
| DE | 10 2013 016 442 | A1 | 4/2015 |
| EP | 2 489 273 | A1 | 8/2012 |
| JP | 2010-008316 | A | 1/2010 |
| SU | 1008122 | A1 | 3/1983 |
| SU | 1698160 | A1 | 12/1991 |
| WO | WO 2014/018129 | A1 | 1/2014 |
| WO | WO 2014/128481 | A1 | 8/2014 |

OTHER PUBLICATIONS

Search Report dated Aug. 4, 2017, in UK Patent Application No. GB1706960.0, 4 pages.

"Forklift", From Wikipedia, the free encyclopedia, [retrieved Aug. 14, 2017]. Retrieved from the Internet: URL <https://en.wikipedia.org/w/index.php?title=Forklift&oldid=793668182>, 12 pages.

First Examination Report for India Patent Application No. 201917041849, with English translation, 7 pages dated Aug. 18, 2021.

Office Action for Russian Patent Application No. 2019138697, translation included, 11 pages dated Sep. 10, 2021.

Search Report for Russian Patent Application No. 2019138697, translation of cited references included, 3 pages dated Sep. 10, 2021.

* cited by examiner

PACKAGING SYSTEM AND METHOD

CROSS-REFERENCE TO RELATED APPLICATIONS

This application is a National Stage filing under 35 U.S.C. § 371 of International Patent Application No. PCT/GB2018/051146, filed Apr. 30, 2018 and entitled "A LIFTING APPARATUS FOR A PACKAGING SYSTEM, A PACKAGING SYSTEM WITH SAID LIFT AND METHODS OF OPERATING SAID SYSTEM TO INSTALL A FEED DEVICE TO OR TO REMOVE A FEED DEVICE FROM A PACKAGING MACHINE," which claims the benefit of priority to GB Application No. 1706960.0, filed May 2, 2017. Both of these applications are incorporated by reference herein in their entirety for all purposes.

FIELD

Embodiments of the present invention relate generally to the installation and maintenance of machines for the processing of packaged commodities. For example, an improved system for maintaining and installing weighers within food packaging facilities is provided which offers significant improvements in cost, efficiency and space requirements.

BACKGROUND

Within the food industry it is common to package food and drink within sealed bags, cartons and trays. Such packaging provides a convenient, secure and hygienic means of distributing, stocking and selling food.

Conventionally, before the food and drink is packaged it is quickly and accurately divided into portions of equal weight and/or volume. This may be performed using a variety of feed devices, such as volumetric feeders or computer controlled weighers (CCWs). These CCWs include combination or multi-head weighers, screw fed weighers, cut gate weighers, linear weighers, and mix weighers.

In modern packaging facilities each feed device is positioned above a corresponding packaging machine (e.g. a bag maker, tray sealer, cartoniser or thermoformer). Consequently food or drink may be gravity fed into the appropriate receptacle within the packaging machine.

However, feed devices are very heavy and typically have a mass of between 300 and 700 kg. For instance, computer controlled weighers commonly have a mass of 500 to 600 kg. Therefore, within conventional packaging facilities the feed devices are supported above each packaging machine by large steel structures. Maintenance operations for the feed devices such as inspections, repairs, servicing and cleaning are performed in situ (i.e. whilst still attached to a packaging machine) from platforms or walkways located on these steel structures. These platforms are typically accessed by operators on the floor of the facilities from stairs.

This structural steelwork is large, expensive and inflexible. Therefore, it is difficult and costly for food and beverage producers to increase the output or capacity of their facilities as they must provide new machinery (including feed device and packaging machinery) and additional steelwork.

Additionally, the existing layouts discussed above have a significant impact on the safety and efficiency of packaging facilities. To access each feed device, machine operators may be required to walk long distances (10*s* of metres) to reach the nearest set of stairs. This increases the time required to service or clean each system. Furthermore, the separate levels create a physical and psychological barrier between workers upstairs on the platforms and those below on the main floor of the facility. This reduces awareness of the situation or status of both levels, leading to a loss of efficiency and increased safety risks.

Furthermore, it is very difficult to completely dismantle existing machinery layouts or to replace feed devices which are irreparably damaged. Commonly this is achieved using traditional moving and handling equipment, e.g. forklift trucks, cranes or other lifting mechanisms. However, in order to achieve efficient and cost effective factory layouts individual bagmakers, traysealers and cartonisers are placed in close proximity. Consequently, there is not sufficient space for conventional lifting equipment to access the machinery. Furthermore, traditional lifting equipment is often considered too hazardous to operate in the compact and noisy environment of a packaging facility without interrupting production.

Accordingly, there is a need to improve existing packaging machinery and facilities.

SUMMARY OF INVENTION

According to a first aspect of invention there is provided a packaging system comprising: a packaging machine configured to detachably couple to a feed device; a lifting apparatus comprising a lifting frame mechanically coupled to the packaging machine, and configured to couple with the feed device; wherein the lifting frame is configured to translate, raise and lower the feed device relative to the packaging machine; wherein the mass of the packaging machine acts to counterbalance at least a portion of the mass of the feed device whilst the feed device is being translated, raised or lowered relative to the packaging machine.

Consequently, systems in accordance with the present invention are able to quickly and safely install feed devices (e.g. volumetric feeders or computer controlled weighers), and remove feed devices from, packaging machines (e.g. bag makers, tray sealers and cartonisers). Furthermore, the systems are able to decouple feed devices from packaging machines and lower the devices for maintenance by operators or technicians on the ground. This increases the speed and efficiency of maintenance operations and reduces system downtime associated with these operations.

By using the mass of the packaging machine as a counter weight, i.e. to at least partly counterbalance the mass of the feed device, very compact lifting mechanisms are achievable. In particular, there is no need to provide additional framework or support and the floor area around a packaging machine may be left free to allow flow of materials and operators during normal production activities. Furthermore, there is no need to provide a large gantry to service the feed device, or any traditional moving and handling equipment or separate freestanding lifting devices and the necessary anchorages.

Advantageously, these systems remove the requirement for much of the structural steelwork and maintenance platforms from packaging facilities. This provides significant cost, space and efficiency savings.

For instance, such systems allow producers to more easily scale their production levels. Increases to factory output may be achieved by simply positioning a self-contained packaging system in a suitable location within the packaging facility. There is no need to modify or extend existing steelwork or provide new steelwork in order to support and for maintenance of the new feed devices.

Furthermore, the present systems provide further increases in safety and efficiency given the single level of the factory. This single storey allows operators to have an increased awareness of the situation or status of their colleagues and the wider production line, leading to improvements in efficiency and safety.

Preferably the lifting apparatus is configured to detachably couple with the feed device.

Consequently, downtime associated with maintenance and cleaning may be dramatically reduced. Instead of conducting inspections, repairs, servicing and cleaning of a feed device in situ (i.e. whilst it is still attached to the top of a packaging machine), each feed device may be removed and replaced with a new one. The feed device which has been removed may then be cleaned or serviced without halting production of the packaged products. This reduces downtime for the packaging machines and decreases the amount of operator time and manning levels required to support the system.

Alternatively, the lifting apparatus may be fixedly coupled to the feed device. This simplifies any connection between the lifting apparatus and the feed device. In such embodiments the feed device may not be removed from the lifting apparatus and replaced. However, maintenance and cleaning may still be performed by operators on the ground after the feed device is uncoupled and dismounted from the packaging machine.

Preferably, the lifting apparatus further comprises a first actuator configured to raise and lower the feed device. By "raise" it is understood that the feed device is lifted up from an initial position to a higher position, whilst "lower" is intended to refer to motion where the feed device is moved down from an initial position to a lower position. Whilst the raising and lowering may require motion in a vertical direction only (i.e. that there is no simultaneous horizontal or lateral motion) this is not essential.

Consequently, the first actuator is able to convey a feed device from the height at which it is coupled to the packaging device to a height at which it may be maintained by an operator (e.g. ground level or the floor of the factory) and to raise a feed device in order to couple it to the packaging machine.

In further alternative preferred embodiments, the first actuator is further configured to translate the feed device relative to the packaging machine.

In such embodiments, the feed device may be translated and either raised or lowered simultaneously. For instance, the first actuator may rotate the lifting frame and the coupled feed device about a substantially horizontal axis such that the feed device is swung to the ground. Alternatively, translation, raising and lowering may each be performed as separate steps such that only a single motion occurs at a time, e.g. to install a feed device the device may be first raised, then translated and finally lowered such that it engages the packaging machine. Accordingly, a transmission, gearing or other mechanical coupling configured to redirect the output motion of the first actuator.

In equally preferred embodiments, the lifting apparatus further comprises a second actuator configured to translate the feed device relative to the packaging machine.

In such an embodiment, the first and second actuators may both be operated simultaneously or in turn to decouple the feed device from a packaging machine for maintenance or to install a feed device to a packaging machine. Such an embodiment avoids the need for a transmission, gearing, driveshaft or other mechanism to redirect the output motion of the first actuator but requires two separate actuators.

In alternative embodiments, one or more actuators may be provided directly to either the packaging device or the feed device. These may be configured to raise, lower or translate the feed device relative to the packaging machine. However, providing a lifting apparatus comprising a first and/or second actuator is considered advantageous as such a lifting apparatus may be easily retrofit to existing machinery.

Preferably the first and/or second actuators comprise a: hydraulic; pneumatic; electric; magnetic; or manual actuator. Alternatively any other suitable actuator or combination of actuators capable of lifting and/or translating the feed device may be used.

In particularly preferred embodiments, the first and/or second actuator comprises a ball screw motor. Such an actuator converts rotational motion from the motor into linear motion with minimal friction. This allows high forces to be applied to the feed device with minimal mechanical losses and high accuracy.

In some embodiments, the lifting frame may be rotated about a substantially vertical axis, such that, when the feed device is coupled to the lifting frame, the feed device may be rotated about the substantially vertical axis.

Rotating the feed device and lifting frame about a substantially vertical axis allows the feed device to be translated in a substantially horizontal direction. In preferred embodiments the substantially vertical axis is substantially parallel to the longitudinal axis of the lifting frame. However, this is not essential. By rotating the feed device and the lifting frame, the space, mechanism and power required to translate the feed device is minimised.

Preferably the lifting frame is mechanically coupled to a corner of the packaging machine. In such cases the substantially vertical axis may be near or adjacent to the corner of the packaging machine and/or a longitudinal axis of the packaging machine. Coupling the lifting frame to an external corner of a packaging machine reduces the space required to raise and lower a feed device and ensures that the entirety packaging machine may be easily accessed by (for instance) operators and or technicians. In addition, where the lifting frame is retrofitted to existing packaging systems, attaching the frame to a corner of a packaging machine may avoid any interference or disruption of pre-existing components and features of the packaging machine.

Alternatively, the feed device may be moved in a linear direction using a linear actuator. For instance, this actuator (which may be either the first or the second actuator as discussed above) may drive the feed device along one or more guide rails above the packaging machine, or extend one or more telescopic arms wherein one end of the telescopic arm(s) is attached to the feed device and the other end of the telescopic arm is attached to the lifting frame.

In equally preferred embodiments, the lifting frame may be rotated about a substantially horizontal axis, such that, when the feed device is coupled to the lifting frame, the feed device may be simultaneously raised or lowered in a vertical plane and translated in a horizontal plane relative to the packaging machine. This enables the simplification of the control system as the vertical and horizontal components of the motion are dependent on one another.

Preferably, the lifting apparatus further comprises a lifting carriage which is mechanically coupled to the lifting frame and may be detachably coupled to the feed device.

In preferred embodiments, the lifting carriage is mechanically coupled to the first actuator.

Advantageously, the lifting carriage may transmit force from the first actuator to the feed device and simplify the coupling between the feed device, lifting apparatus and at least the first actuator. Alternatively, the lifting frame and the first actuator may be coupled directly to the feed device.

In preferred embodiments, the feed device comprises a grader, a batcher, a volumetric feeder or a computer controlled weigher (CCW) such as: a combination weigher, a multihead weigher; a screw feeder weigher; a cut gate weigher; a linear weigher; or a mix weigher.

In preferred embodiments, the packaging machine comprises at least one: bag maker; tray sealer; cartonising machine; or thermoformer.

Preferably, the mass of the packaging machine acts to counterbalance at least 50% of the mass of the feed device whilst the feed device is being raised, lowered or translated relative to the packaging machine, more preferably at least 75%, more preferably at least 90%, more preferably still at least 95%. In some preferred embodiments the mass of the packaging machine completely counterbalances the mass of the feed device and/or the lifting apparatus when whilst the feed device is being raised, lowered or translated relative to the packaging machine. This avoids the need for any further supports, fixings or anchorages to be provided to the packaging system.

However, in some alternative embodiments of the present invention the lifting frame further comprises one or more supports, wherein the support bears a portion of the combined mass of the lifting frame and the feed device whilst the feed device is being raised, lowered or translated relative to the packaging machine. In further alternative embodiments, a portion of the mass of the feed device may be counteracted by fixings or anchorages coupling the packaging machine to the structure supporting the packaging system.

Advantageously, this support may be reduced in size and strength resulting in a reduction in the material required and manufacturing costs as the proportion of the mass of the feed device counterbalanced by the packaging machine increases.

In further preferred embodiments, the lifting frame is mechanically coupled to the packaging machine by a cantilever. As such, the mass of the lifting frame and the feed device during lifting is supported entirely by cantilever and counterbalanced by the mass of the packaging machine and so no additional support is required. This reduces the material required, the manufacturing costs of the packaging system and the space it requires.

Preferably the system further comprises at least one sensor able to detect the presence of a foreign object in the path of the feed device.

Such foreign objects include any that is not part of the packaging system, such as people, other machinery or equipment. If a foreign object is detected any installation or removal of a feed device may be automatically interrupted. This is critical for the safety of the factory operators and to avoid damage to the machinery involved, especially in view of the large size and mass of conventional feed devices.

These sensors may be disposed on any suitable component of the packaging system. For instance, the sensors may be located on the lifting frame, packaging machine or feed device. Advantageously, the sensors are positioned on the lifting apparatus to allow the sensors to be retrofit to existing packaging machinery and feed device systems.

Preferably said at least one sensor is a laser sensor. Such sensors are inexpensive, accurate and highly reliable. Alternatively, any suitable sensor capable of detecting the presence of a foreign object may be used, such as a light gate, visible light sensor or UV sensor. In further alternative embodiments, a weight sensor may be positioned underneath the path of the feed device.

In preferred embodiments, the system may further comprise a sub frame which may be detachably coupled to the lifting frame and the feed device.

The sub frame may act as an interface between the lifting frame, the feed device and the packaging machine. Advantageously, the sub frame may be designed to transmit forces between these devices, thus avoiding damage to delicate components within the devices. Additionally, the sub frame may provide a designed to interface with further devices such as a trolley or a feed device washer. Furthermore, a sub frame may enable the packaging system discussed above to be retrofitted to existing feed devices and packaging machines.

Alternatively, the lifting frame and/or packaging machine may be directly coupled to the feed device.

In particularly, preferred embodiments the packaging machine further comprises a first service connector, the first service connector configured to engage with a corresponding second service connector when the packaging machine and the feed device are coupled.

Preferably, the service connectors transfer at least one of electrical power, fluids, gases, or control signals between the packaging machine and the feed device.

Advantageously, the service connectors allow the packaging machine and feed device to interface and to share service inputs. For instance, the transfer of control signals enables the implementation of complex control methods, e.g. a packaging machine may automatically adjust to changes in flow of material through a feed device to avoid fouling, wastage or unnecessary downtime. Furthermore, if services such as electrical power, fluids and gases are shared between the packaging machinery and the feed device the two devices may be more efficiently designed together.

Advantageously, a single pair of connectors is able to transfer all of electrical power, fluids, gases and control signals. However, this is not essential.

In alternative embodiments, services may not be transferred between the feed device and the packaging machine, and instead they may be provided with independent service supplies.

In some preferred embodiments, the second service connector is disposed on the feed device. However, in equally preferred embodiments, the second connector is disposed on the sub frame, such that at least one of electrical power, fluids, gases or control signals may be transferred between the packaging machine and the feed device via the sub frame when the feed device is coupled to the packaging machine and the feed device.

In alternative embodiments, services are transferred between the feed device and the packaging machine via the lifting frame. One or more sets of the service connectors discussed above may connect the lifting frame to the feed device and the lifting frame to the packaging machine.

In preferred embodiments, the service connectors may be disengaged from one another by raising the feed device away from the packaging machine, and/or the service connectors may be engaged together by lowering the feed device towards the packaging machine.

Thus, the service connectors may be engaged and disengaged simply by the movement of the feed device. Advantageously, no further steps are required to engage or disengage the feed device to the packaging machine.

Preferably, one of the first service connector and the second service connector is a female connector and the other is a male connector.

As is commonly known in the art a female connector commonly comprises a port or receiving portion which receives the corresponding male connector. In particularly preferred embodiments the first service connector (disposed on the packaging machine) is a female connector, and the second service connector (disposed on either the feed device or the sub frame) is a male connector. However, this is not essential.

Providing a male connector to the feed device or the sub frame and the female connector to the packaging machine is considered particularly advantageous because the concealed or recessed female connector is typically less fragile or prone to damage than the male connector. Consequently, damage is more likely to occur to the male connector and the male connector is more likely to need repair or replacement than female connector. Therefore, it is advantageous to provide the male connector to the feed device which may be easily decoupled or removed from the packaging machine for maintenance using the systems described above. This reduces operator hours and the maintenance required, and may avoid unnecessary downtime if the feed device is switched out for a new feed device.

In preferred embodiments, the system further comprises a recess disposed on a first surface and a corresponding protrusion disposed on a second surface, wherein the protrusion engages the recess when the packaging machine and feed device are coupled.

Advantageously, the protrusion and recess will only engage if the feed device and packaging machine are correctly orientated relative to one another. As such, the protrusion and the recess act as guides and help ensure that the feed device and packaging machine are correctly aligned when they are coupled (i.e. brought into contact). Furthermore, they ensure that the feed device is securely retained in contact with the. Each of these effects increases the safety of the system, helping to avoid damage to the machinery or injury to its operators.

In particularly preferred examples, the protrusion extends further from the second surface than the first or second service connectors, such that during the coupling of the feed device and the packaging machine the protrusion will enter the recess before the first and second service connectors engage.

Consequently, if the feed device and the packaging machine are misaligned (i.e. not in the correct orientation relative to one another to be coupled) the protrusion will not enter the recess when the feed device is brought towards the packaging machine. Therefore, when the feed device and packaging machine are not correctly orientated, the protrusion will prevent the two pieces of machinery contacting incorrectly. This acts to prevent damage to the feed device and the packaging machinery and in particular any delicate connectors disposed on either device.

In preferred embodiments the recess comprises a base surface which is inset within the first surface and at least one recess side provided between the base surface and the first surface; wherein said at least one recess side continuously or discontinuously narrows from the first surface to the base surface of the recess.

In further preferred embodiments the protrusion comprises a top surface which is raised from the second surface and at least one protrusion side provided between the top and the second surface; wherein said at least one protrusion side continuously or discontinuously narrows from the second surface to the top surface of the recess.

In other words, the protrusion or recess will be tapered and reduce in thickness towards the end furthest from the surface on which they are disposed. For instance, either the protrusion and/or recess may be formed as truncated cone, or have a stepped surface. Advantageously, when the feed device is brought into contact with the packaging machine the protrusion or recess will cause the feed device to move laterally to the direction of its movement in order to correctly align the feed device to the packaging machine. In other words, the mechanical protrusion and recess accurately locate the feed device (and any sub frame) relative to the packaging machine.

Preferably both the protrusion and the recess narrow as discussed above. However, this is not essential.

Preferably the recess is positioned on the packaging machine and the protrusion is disposed on either the feed device or the sub frame, or the recess is disposed on either the feed device or the sub frame and the protrusion is disposed on the packaging machine.

According to a second aspect of invention there is provided a lifting apparatus comprising:

- a lifting frame configured to be mechanically coupled to a packaging machine, and configured to couple with a feed device;
- wherein the lifting frame is configured to translate, raise and lower the feed device relative to the packaging machine;
- wherein in use the mass of the packaging machine acts to counterbalance at least a portion of the mass of the feed device whilst the feed device is being translated, raised or lowered relative to the packaging machine.

It will be seen that the lifting apparatus forms part of the packaging system discussed above. In further embodiments it may comprise any of the further features of the lifting apparatuses within the systems discussed above, thus providing the corresponding benefits and advantages.

According to a third aspect of invention there is provided a method of operating a system according to the first aspect of the invention to install a feed device to a packaging machine, comprising the steps of:

- positioning the feed device adjacent to the packaging machine;
- coupling the feed device to a lifting apparatus;
- operating the lifting apparatus to raise and translate the feed device relative to the packaging machine;
- operating the lifting apparatus to lower the feed device, such that feed device is coupled to the packaging machine;
- wherein the mass of the packaging machine acts to counterbalance at least a portion of the mass of the feed device whilst the feed device is being translated, raised or lowered relative to the packaging machine.

The steps of raising and translating the feed device may be performed simultaneously (i.e. where the motion of the feed device has a vertical component and a horizontal component) or separately, wherein the feed device is first raised vertically and then translated. Similarly, the steps of translating and lowering the feed device may be performed simultaneously (i.e. where the motion of the feed device has a vertical component and a horizontal component) or separately, wherein the feed device is first translated and then lowered.

In preferred embodiments the method comprises the subsequent step of decoupling the feed device from the lifting apparatus in at least one degree of freedom. Advantageously, this may reduce the vibrations and forces transmitted between the packaging machine, feed device and lifting apparatus. This decoupling ensures the accuracy of the feed device and the weighing and portioning equipment within it by ensuring that no vibration is transferred to these components from the lifting device.

Preferably the step of raising the feed device comprises a first raising step where the feed device is raised at a relatively low speed and a second raising step where the feed device is raised at a relatively high speed.

Advantageously, during the first raising step the feed device may be carefully lifting from its original position (e.g. from a transport trolley, or the ground) such that it is supported by the lifting apparatus. Once an operator is confident that the feed device is correctly coupled to the lifting frame and that the area around the packaging system is clear of any foreign objects the second, faster raising step may be performed. Consequently, the two step raising process increases safety and helps to avoid damage to the system.

In preferred embodiments, the first raising step is controlled manually, whilst the second raising step and all subsequent steps are performed automatically. Alternatively any of the steps described above may be performed automatically, or in response to a user input.

According to a fourth aspect of invention there is provided a method of operating a system according to the first aspect of the invention to remove a feed device from a packaging machine, comprising the steps of:

coupling the feed device to a lifting apparatus;

operating the lifting apparatus to raise the feed device, such that feed device is decoupled from the packaging machine;

operating the lifting apparatus to translate and lower the feed device relative to the packaging machine;

decoupling the feed device from the lifting apparatus;

wherein the mass of the packaging machine acts to counterbalance at least a portion of the mass of the feed device whilst the feed device is being translated, raised or lowered relative to the packaging machine.

Preferably, operating the lifting apparatus to lower the feed device comprises a first lowering step where the feed device is lowered at a relatively high speed and a second lowering step where the feed device is lowered at a relatively low speed.

Advantageously, the second lowering step allows a feed device to be carefully lowered onto a trolley or the ground for later removal. The slow speed of this step helps to prevent damage to the feed device as it is unloaded from the lifting apparatus.

Preferably the second lowering step is controlled manually, whilst the first lowering step and all preceding steps are performed automatically. Alternatively any of the steps described above may be performed automatically, or in response to a user input.

BRIEF DESCRIPTION OF DRAWINGS

Examples of security documents and methods for their manufacture will now be described with reference to the accompanying drawings, in which:

FIG. 1(*b*) depicts a schematic side view of packaging system wherein a feed device has been dismounted in accordance with a first embodiment of the present invention;

FIG. 2(*b*) depicts a schematic side view of packaging system wherein a feed device has been dismounted in accordance with a second embodiment of the present invention;

FIG. 3(*b*) depicts a schematic side view of packaging system wherein a feed device has been dismounted in accordance with a third embodiment of the present invention;

DETAILED DESCRIPTION

FIGS. 1 to 7 illustrate schematically four packaging systems which offer improved means of installing, removing and maintaining feed devices. Such maintenance work includes inspecting, cleaning, servicing and repairing feed devices.

In each case, the feed devices may include graders, batchers, a volumetric feeders or computer controlled weighers (CCWs) such as combination, multihead, feeder, cut gate, linear, or mix weighers. Such feed devices typically have a mass of between 300 kg and 700 kg. Whereas, suitable packaging machines include bag makers, tray sealers, cartonising machines and thermoformers. Typically such packaging machines have a mass of between 500 kg and 800 kg. In conventional packaging systems the feed device tends to be of a lower mass than the correspondingly scaled packaging machine. Consequently, the inventors have realised that the mass of a packaging machine may be used to counteract or counterbalance the mass of a feed device when it is mounted or dismounted.

Figure 1A:
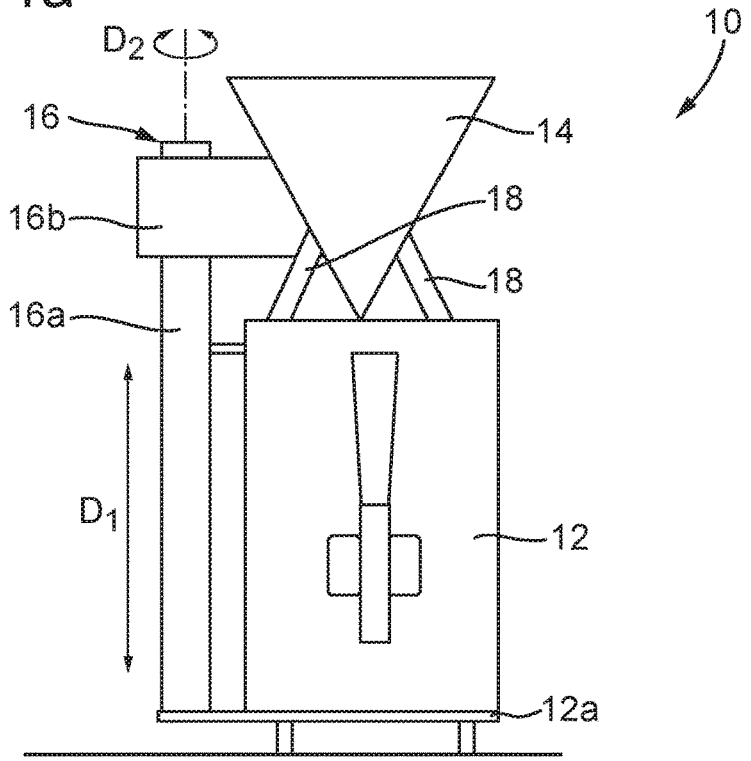
FIG. 1(*a*) depicts a schematic side view of packaging system in operation in accordance with a first embodiment of the present invention.
Figure 1B:
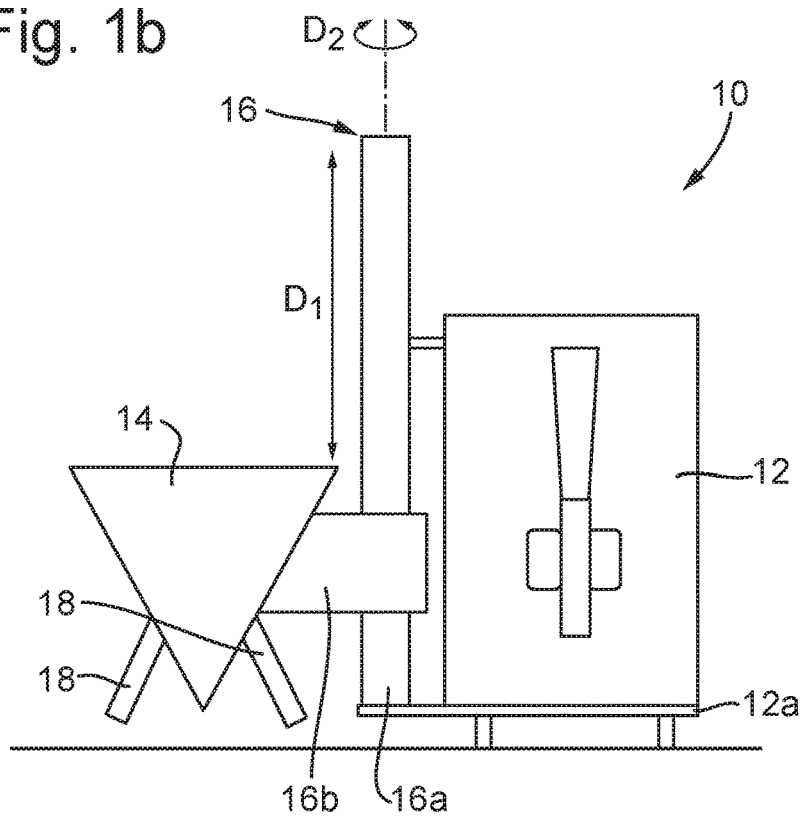
Figure 2A:
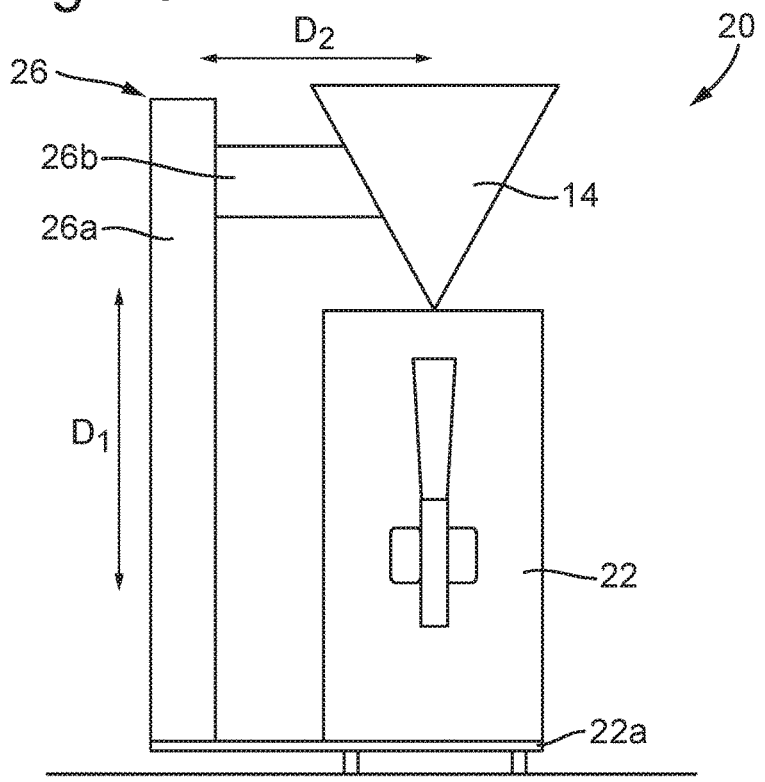
FIG. 2(*a*) depicts a schematic side view of packaging system in operation in accordance with a second embodiment of the present invention.
Figure 2B:
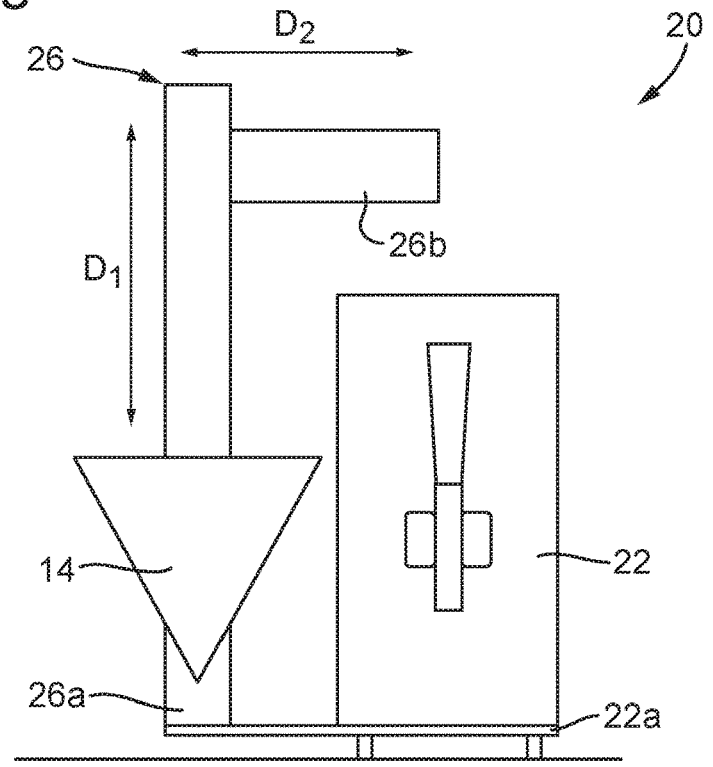
Figure 3A:
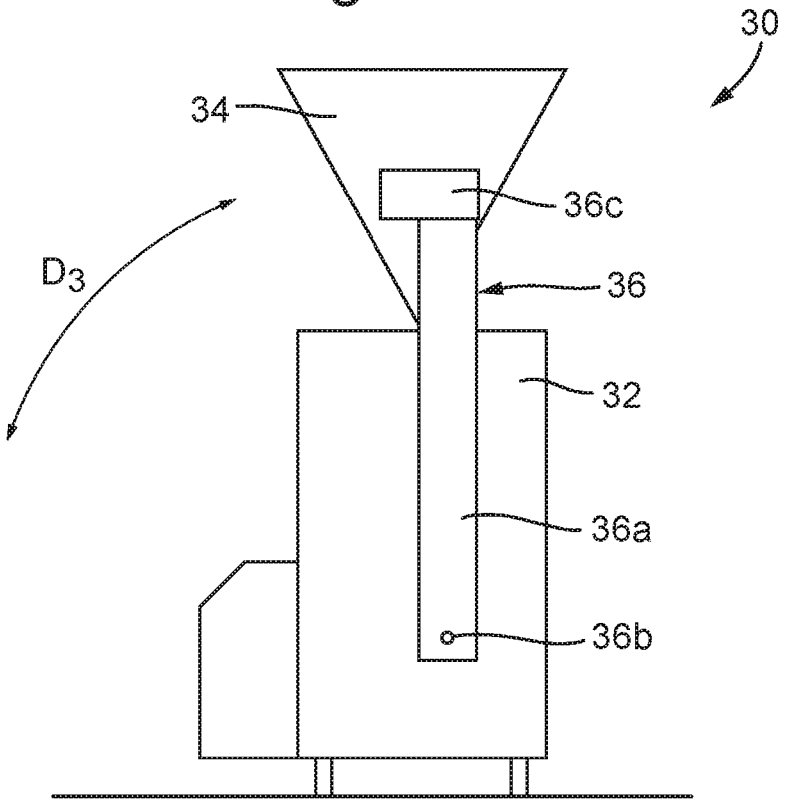
FIG. 3(*a*) depicts a schematic side view of packaging system in operation in accordance with a third embodiment of the present invention.
Figure 3B:
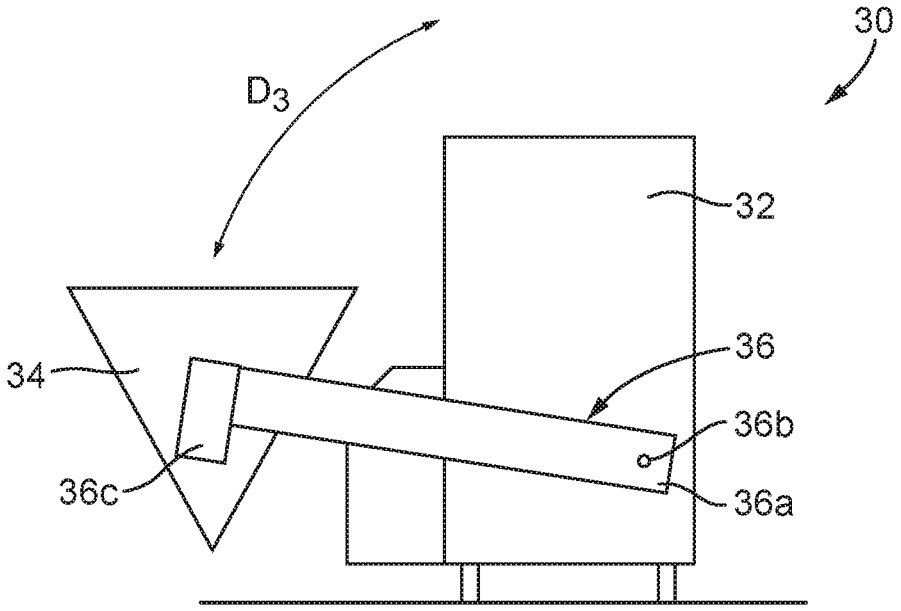
Figure 4B:
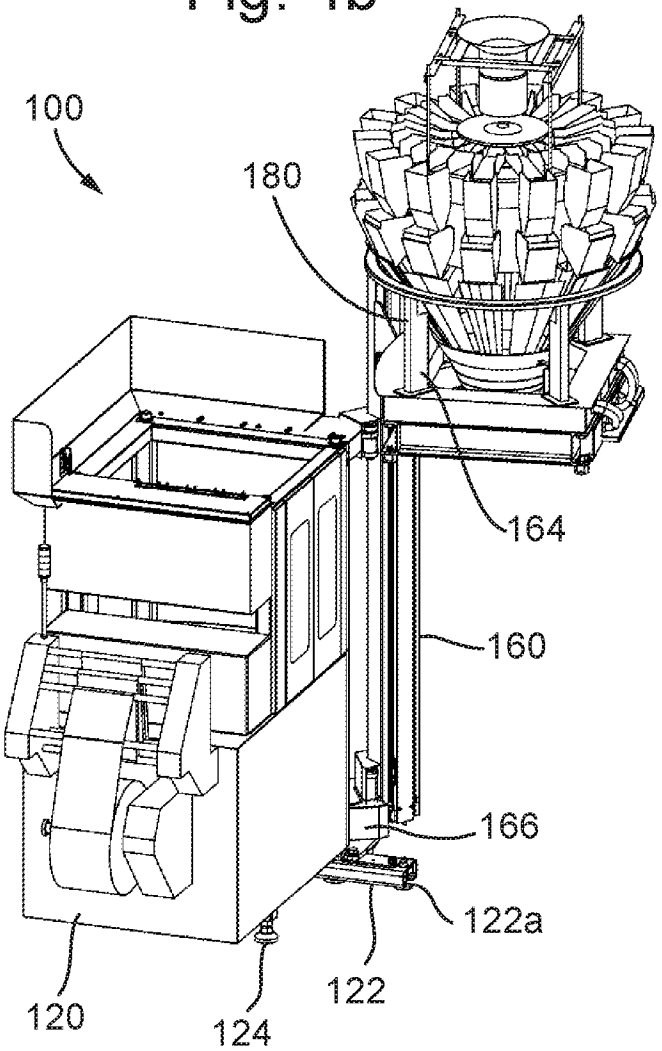
FIGS. 4(*a*), 4(*b*), 4(*c*) and 4(*d*) depict projection views of a packaging system in accordance with a first embodiment of the present invention.
Figure 4A:
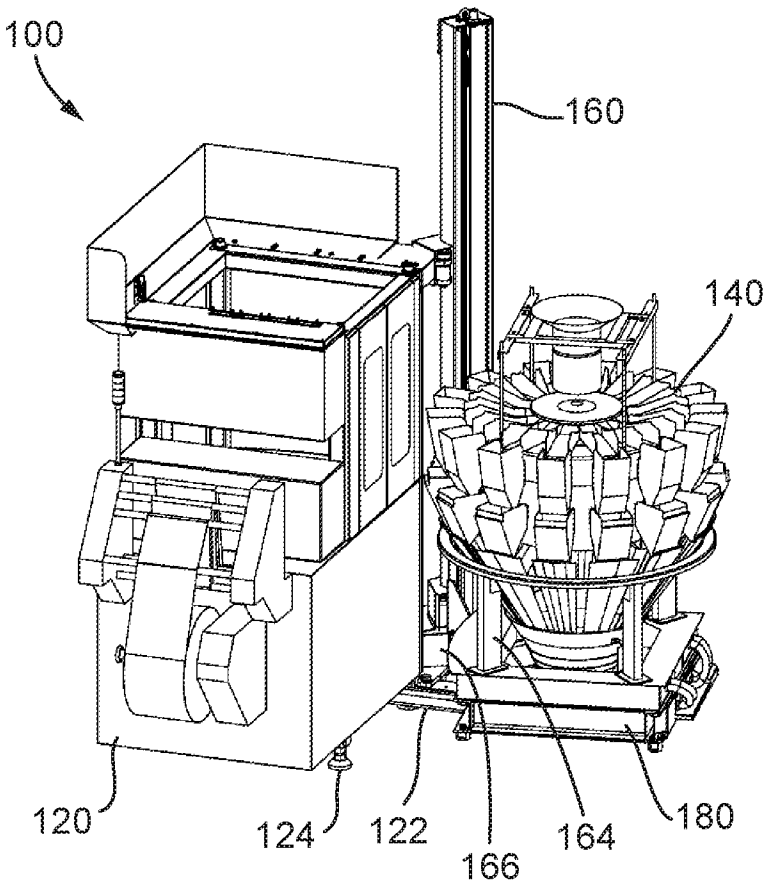
Figure 4D:
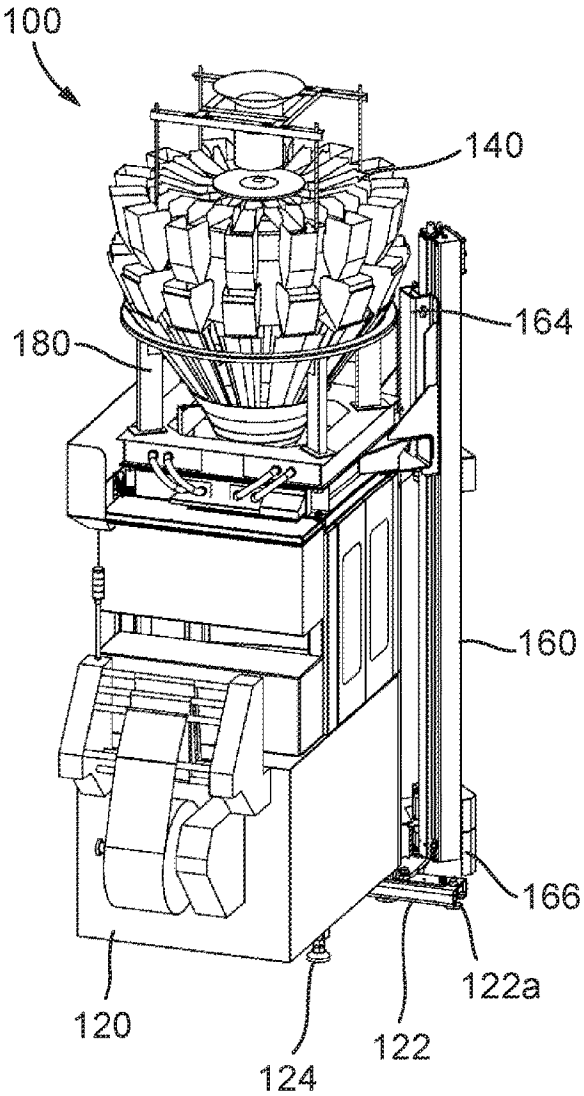
Figure 4C:
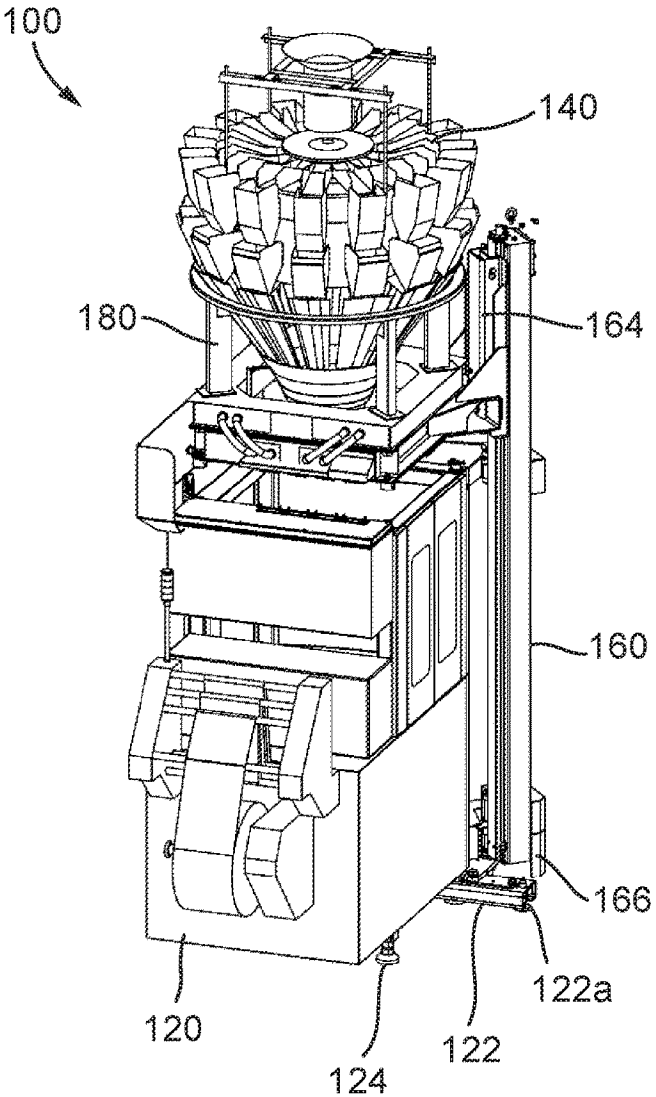

FIGS. 1 to 3 illustrate schematically three alternative embodiments of packaging systems. The reference signs for corresponding features (which may have similar properties or features as described in reference to any of the other figures) have been incremented by 10 between each embodiment.

FIGS. 1(*a*) and 1(*b*) show a packaging system 10 comprising a packaging machine 12, a feed device 14 and a lifting apparatus 16.

In FIG. 1(*a*) the feed device 14 is installed to a packaging machine 12, as it would be in normal operation. As will be seen, the feed device 14 is coupled to the top of the packaging machine 12. Whereas, in FIG. 1(*b*) the feed device 14 has been dismounted from the packaging machine 12, i.e. the feed device 14 has been uncoupled from the packaging machine 12 and lowered by the lifting apparatus 16 to a position adjacent to the packaging machine 12 and close to the ground. In this dismounted position the feed device 12 may be easily inspected, serviced or cleaned. Alternatively, from the dismounted position shown in FIG. 1(*b*) the feed device 12 may easily uncoupled from the lifting apparatus 16 and removed completely if required.

The lifting apparatus 16 comprises lifting frame 16*a*, which has the form of a substantially vertical mast, and a moveable carriage 16*b*. The movable carriage 16*b* may move linearly up and down the lifting frame 16*a*, as shown by arrow $D_1$, and may rotate about a substantially vertical axis, as shown by arrow $D_2$. Control of this motion may be performed by one or more actuators (not shown).

These one or more actuators may be of any suitable design capable of translating, raising and lowering the feed device 14 relative to the packaging machine 12.

The substantially vertical axis about which the movable carriage 16*b* may rotate is preferably substantially parallel to the centreline of the mast of the lifting frame 16*a*. For instance, the lifting frame 16*a* and the movable carriage 16*b* may rotate together about a single axis which is close to the centreline of the lifting frame 16*a*. Alternatively, the movable carriage 16*b* may be configured to rotate around the outside of the lifting frame 16*a*, which may be fixed in position.

In both of these embodiments the substantially vertical axis may be coincident with the centreline of the lifting frame 16*a*. However, in alternative embodiments the substantially vertical axis is within 0.3 m of the centreline of the lifting frame 16*a*, or within 0.15 m of the lifting frame 16*a*.

Additionally, the movable carriage 16*a* is configured to detachably couple with the feed device 14. Consequently, the feed device 14 may also be raised, lowered and rotated (i.e. translated) about a substantially vertical axis by the movable carriage 16*a*.

The lifting apparatus 16 is supported by a cantilever 12*a*. This cantilever extends between, and is coupled to, the base of the packaging machine 12 and the base of the lifting frame 16*a*. Therefore, whilst the feed device 14 is being raised, lowered and translated by movable carriage 16*a*, or during maintenance operations, the combined mass of the feed device 14 and lifting apparatus 16 is counterbalanced or counteracted by the mass of the packaging machine. By counterbalancing the lifting apparatus in this manner, the structure required to install, remove and maintain the feed device is significantly simplified.

The system 10 further comprises a sub frame 18 coupled to the feed device 14. This sub frame 18 supports the feed device 14 when it is coupled to the packaging machine 12.

The lifting apparatus 16, lifting frame 16*a*, moveable carriage 16*b*, cantilever 12*a* and sub frame 18 may be formed of any suitable material capable of supporting the feed device 14 during the installation, removal or maintenance. For instance, each component may comprise a metal (such as steel, aluminium, titanium, or an alloy thereof), a plastic or a composite.

To dismount the feed device 12 in order to remove or maintain the feed device 14 the system must move from the arrangement of FIG. 1*a* to the arrangement shown in FIG. 1*b*.

This lowering operation requires first that the feed device 14 be uncoupled from the packaging machine 12. This is typically achieved by lifting the feed device 14 relative to the packaging machine 12.

The feed device 14 and the movable carriage 16*b* are then rotated about a substantially vertical axis (as shown by arrow $D_2$), such that the feed device 14 is swung out from above the packaging machine 12. In other words, the feed device 14 is translated relative to the packaging machine 12, such that it is not positioned over and does not overlap the packaging machine 12 in a vertical direction.

Finally, the movable carriage 16*b* lowers the feed device 14 to the lowered or dismounted position shown in FIG. 1*b*. Once in this dismounted position an operator may conduct maintenance whilst the feed device 14 is still connected to the lifting apparatus 16 or, if necessary, completely remove the feed device 14 from the packaging system 10.

In this dismounted position the feed device 12 may be easily inspected, serviced or cleaned. Alternatively, from the dismounted position shown in FIG. 1(*b*) the feed device 12 may easily uncoupled from the lifting apparatus 16 and removed completely if required.

To install or mount the feed device 14 to the packaging system 10 this process is reversed, and the feed device 14 must be conveyed from its dismounted position shown in FIG. 1*b* to the installed position of FIG. 1*a*.

Specifically, the feed device 14 is raised or lifted to a height above the packaging machine 12 by the movable carriage 16*b*, swung over the packaging machine 12 by rotating the movable carriage 16*b* and the feed device 14 about a substantially vertical axis, and finally lowered to couple the feed device 14 to the packaging machine 12.

These mounting and dismounting cycles or processes (and each of the steps therein) may be performed under manual or automatic control. Furthermore, they may be performed in response to an input received from a user, or automatically, e.g. in response to a control signal issued by a control system following the detection of a fault with the feed device.

FIGS. 2(*a*) and 2(*b*) show a packaging system 20 comprising a packaging machine 22, a feed device 24 and a lifting apparatus 26. FIG. 2(*a*) shows the packaging system 20 in its operating arrangement where the feed device 24 is coupled to the packaging machine 22. FIG. 2(*b*) shows the system in an arrangement where the feed device 34 has been dismounted for maintenance (e.g. inspection, cleaning, servicing or repairs).

Lifting apparatus 26, which is able to convey the feed device 24 between the positions shown in FIGS. 2(*a*) and 2(*b*), comprises a lifting frame 26*a*, in the form of substantially vertical mast, and horizontal guides 26*b*.

The feed device 24 may be raised and lowered linearly up and down the lifting frame 26*a* in direction $D_1$, and translated in a substantially horizontal direction $D_2$ along horizontal guides 26*b*. Control of these motions may be performed by one or more actuators (not shown). In further embodiments the lifting apparatus may further comprise a movable carriage to which one or more actuators are coupled, wherein the movable carriage is configured to detachably couple to the feed device 24 and to move along the lifting frame 26 in substantially vertical direction $D_1$.

The lifting apparatus 26 is supported by cantilever 22*a* which extends between and couples to the base of the packaging machine 22 and the base of the lifting frame 26. The mass to one side of the cantilever is at least partially counterbalanced by the mass on the other side. In effect, the mass of the lifting apparatus and feed device, when coupled to the lifting apparatus, is at least partially counterbalanced by the mass of the packaging machine.

To dismount the feed device 24 (i.e. to move from the arrangement shown in FIG. 2(*a*) to the arrangement of FIG. 2(*b*)), the feed device 24 is first uncoupled from the packaging machine 22. The feed device is then translated or slid linearly in a substantially horizontal direction $D_2$ along, or by, the horizontal guides 26*b*. Once the feed device 24 no longer sits above or overlays the packaging machine 22 it may be lowered in a substantially vertical direction $D_1$.

Once the feed device 24 is in this lowered or dismounted position it may be maintained in place by an operator or removed for further work if necessary.

To remount or install a feed device 24 this process is reversed. A feed device is coupled to the lifting frame 26, lifted substantially vertically (as shown by arrow $D_1$), and translated along guides 26*b* or by the guides 26 such that the feed device is coupled to the packaging machine 22.

As discussed in reference to the systems shown in FIGS. 1(*a*) and 1(*b*), these dismounting and mounting cycles may be performed either under manual control or automatically.

In packaging systems 10 and 20, described with reference to FIGS. 1 and 2, the lifting apparatus 16, 26 may raise, lower and translate the feed device 14, 24 in separate operations. For instance, when a feed device is mounted to the packaging machines using the methods described above, the feed device is firstly raised to an appropriate height above the packaging machine and secondly translated horizontally such that it may be coupled to the packaging machine. Conversely, when the feed device is dismounted it may be translated and then lowered. However, in both systems 10, 20, the lifting apparatus 16, 26 may simultaneously raise and translate, or lower and translate, the feed device 14, 24 if required.

FIGS. 3(*a*) and 3(*b*) show a packaging system 30 comprising a packaging machine 32, a feed device 34 and a lifting apparatus 36. FIG. 2(*a*) shows the packaging system 30 in its operating arrangement where the feed device 34 is coupled (mounted) to the packaging machine 32. FIG. 2(*b*) shows the system in an arrangement where the feed device 34 has been dismounted for removal or maintenance.

Lifting apparatus 36 is able to convey the feed device 34 between the positions shown in FIGS. 3(*a*) and 3(*b*). The lifting apparatus 36 comprises a lifting frame 36*a*, in the form of two movable arms. The movable arms of the lifting frame 36*a* are mechanically coupled to either side of the packaging machine 32 by bearings 36*b* about which the lifting frame 36*a* may rotate. Control of this rotation may be provided by one or more actuators (not shown). In alternative embodiments the lifting frame 36*a* may comprise any number of vertical arms.

To mount and dismount a feed device 34, the lifting frame 36*a* and feed device 34 are rotated about the substantially horizontal axis defined by bearings 36*b* (as shown by arrow $D_3$). In each process the motion of the feed device 34 has vertical and horizontal components.

Specifically, the lifting frame 36*a* may be swung up or raised to couple the feed device 34 to the packaging machine 32 (as shown in FIG. 3(*a*)). During this step the feed device 34 is simultaneously raised and translated. In this arrangement the lifting frame 36*a* is substantially vertical and the feed device 34 is above the packaging machine 32. To dismount the feed device 34 the lifting frame 36*a* is swung down (lowered) to dismount the feed device 34 so that it is located adjacent to the packaging machine 32 (as shown in FIG. 3(*b*)). In this step the feed device is lowered and translated simultaneously.

The lifting frame 36*a* further comprises a sub frame 36*c*, which rotatably couples the lifting frame 36*a* to the feed device 34. As shown, the sub frame 36*c* is configured to ensure the feed device 34 remains in its upright (i.e. vertical orientation) whilst it is raised any lowered by the lifting apparatus 36. Control of the orientation may be provided by one or more actuators (not shown) coupled to the feed device 34, the sub frame 36*c* and/or the lifting frame 36*a*.

Whilst the feed device 34 is being mounted or dismounted, and whilst the feed device is adjacent to the packaging device 32, as shown in FIG. 3(*b*), the lifting frame 36*a* acts as a cantilever. In other words, the forces applied by the mass of the feed device 34 and the weight of the lifting apparatus 36 are transmitted to the packaging machine 32 through bearings 36*b*. Consequently, these forces are at least partially counterbalanced by the weight of the packaging machine 32, and the mass of the packaging machine 32 acts to counterbalance the mass of the feed device 34 and the lifting apparatus 36.

In further embodiments the sub frame 36*c* and/or the lifting frame 36*a* may be configured to raise or lower the feed device 34 once the lifting frame 36*a* is in a substantially vertical orientation and the feed device is above the packaging machine 32 (as shown in FIG. 3*a*). This may be necessary to couple or uncouple the feed device 34 to the packaging machine 32, as discussed with reference to FIGS. 1(*a*) and 1(*b*).

As discussed above in reference to the systems of FIGS. 1 and 2, the dismounting and mounting processes performed by the packaging system 30 shown in FIGS. 3(*a*) and 3(*b*) may be under manual or automatically control and be implemented in response to any suitable input.

FIGS. 4 to 8 show detailed perspective views of a packaging system 100 in accordance with a preferred embodiment of the present invention. The system comprises a packaging machine 120, a feed device 140 and a lifting apparatus 160. This embodiment offers improved means of mounting and dismounting the feed device 140 to and from the packaging machine 120 such that the feed devices 120 may be easily installed, removed and maintained.

In this embodiment, feed device 140 is a combination weigher (sometimes termed a multihead weigher) and packaging machine 120 is a bagmaker, although any other suitable devices may be used.

FIG. 4(*a*) to FIG. 4(*d*) show a series of system arrangements illustrating the process to install or mount a feed device 140 to the packaging machine 120.

In FIG. 4(*a*) the feed device 140 is dismounted from the packaging machine 120 and mechanically coupled to lifting apparatus 160. In this dismounted arrangement feed device 140 is located adjacent to the packaging machine 120 and close to the ground such that it may be easily maintained by an operator.

More specifically, the feed device 140 is coupled to a sub frame 180, wherein the sub frame 180 is detachably coupled to a movable carriage 164 within the lifting apparatus 160. This movable carriage is configured to move linearly up and down the longitudinal axis of the lifting frame 162.

The base of lifting frame 162 is coupled to packaging machine 120 by cantilever 122. Cantilever 122 supports the feed device 140, lifting apparatus 160 and the sub frame 180. During maintenance and mounting and dismounting processes, the mass of the packaging machine acts to counterbalance the combined mass of the feed device 140, lifting apparatus 160 and the sub frame 180. As shown in FIGS. 4(*a*) to 4(*d*), lifting frame 162 is coupled to packaging machine 120 at a corner of the packaging machine 120.

Between FIG. 4(*a*) and FIG. 4(*b*) the feed device 140 is raised by lifting apparatus 160. This is achieved by raising the movable carriage 164 relative to the lifting frame 162 using a ball screw actuator (not shown) which is positioned within lifting frame 162. Consequently, the movable carriage raises the sub frame 180 and the feed device 140 which it is mechanically coupled to.

Following this lifting or raising step, the feed device 140 is positioned at a greater height than the position of the feed device 140 during operation (when it is coupled to the packaging machine 120).

Once the feed device 140 has been raised to the position shown in FIG. 4(*b*), it is swung over the packaging machine 120, as shown in FIG. 4(*c*).

This horizontal translation of the feed device 140 is performed by ball screw actuator 166. This ball screw actuator 166 rotates the lifting frame 162 about a substantially vertical axis parallel to the longitudinal axis of the lifting frame 162. Consequently, the ball screw actuator 166 also rotates the feed device 140 (and the movable carriage and sub frame 180) about this substantially vertical axis because these components are mechanically coupled to the lifting frame 162. As seen from the figures, the substantially vertical axis and the longitudinal axis of the lifting frame 162 are adjacent to the corner of the packaging machine 120.

Finally, the feed device 140 is lowered from its position above the packaging machine 120 (as shown in FIG. 4(*c*)) so that it contacts and couples with the packaging machine 120 (as shown in FIG. 4(*d*)). This lowering is performed by the ball-screw actuator located within the hollow lifting frame 162.

Once positioned as shown in FIG. 4(*d*), the feed device 140 may be operated to provide food, and other products to the packaging machine 120 for packaging.

To dismount a feed device, the above process is reversed. The feed device 140 is raised by the ball-screw actuator within the lifting frame 162, decoupling the feed device 140 from the packaging machine 120 (as would occur between FIG. 4(*d*) and FIG. 4(*c*)). The feed device 140 is then swung out (i.e. rotated about a vertical axis) by ball-screw actuator 166 so that it does not overlap the packaging machine 120 (as shown in FIG. 4(*b*)). Finally, the ball-screw actuator and movable carriage within the lifting frame 162 lower the feed device to the position of FIG. 4(*a*) where it is adjacent to the packaging machine and may be easily maintained or removed by an operator standing on the same level as the packaging machine as required.

These processes may be performed under user or automatic control, and in response to any suitable input (e.g. a user input, an error or misfeed detected in either the packaging machine 120 or the feed device 140, or in accordance with a pre-configured maintenance schedule).

As discussed above, during maintenance of the feed device 140 whilst it is adjacent to the packaging machine 120 (as shown in FIG. 4(*a*)), and during the transfer of the feed device between the dismounted and mounted arrangements (FIGS. 4(*a*) and 4(*d*) respectively) the mass of the packaging machine acts to counterbalance the majority of the mass of feed device 140. The counterbalanced forces are transmitted across cantilever 122 which is coupled to the packaging machine 120 at one end and the lifting frame 162 at the other.

The weight of the packaging machine 120 and the counterbalanced weight of are transmitted to the surface on which the packaging system 100 is positioned by packaging machine supports 124.

The remaining portion of the mass of the feed device 140 and lifting mechanism is supported by lifting mechanism support 122*a*. This lifting mechanism support 122*a* transmits a portion of the weight of the feed device 140 and the lifting mechanism 160 to the surface on which the packaging system is positioned. The lifting mechanism support 122*a* coupled to cantilever 122*a* at the end of the cantilever 120 closest to the lifting apparatus 160.

Although two ball-screw actuators are used within lifting apparatus 160, in practice any suitable actuators capable of raising, lowering and translating the feed device 140 may be used instead. These may include hydraulic, pneumatic, electric, magnetic and manual actuators.

Figure 5A:
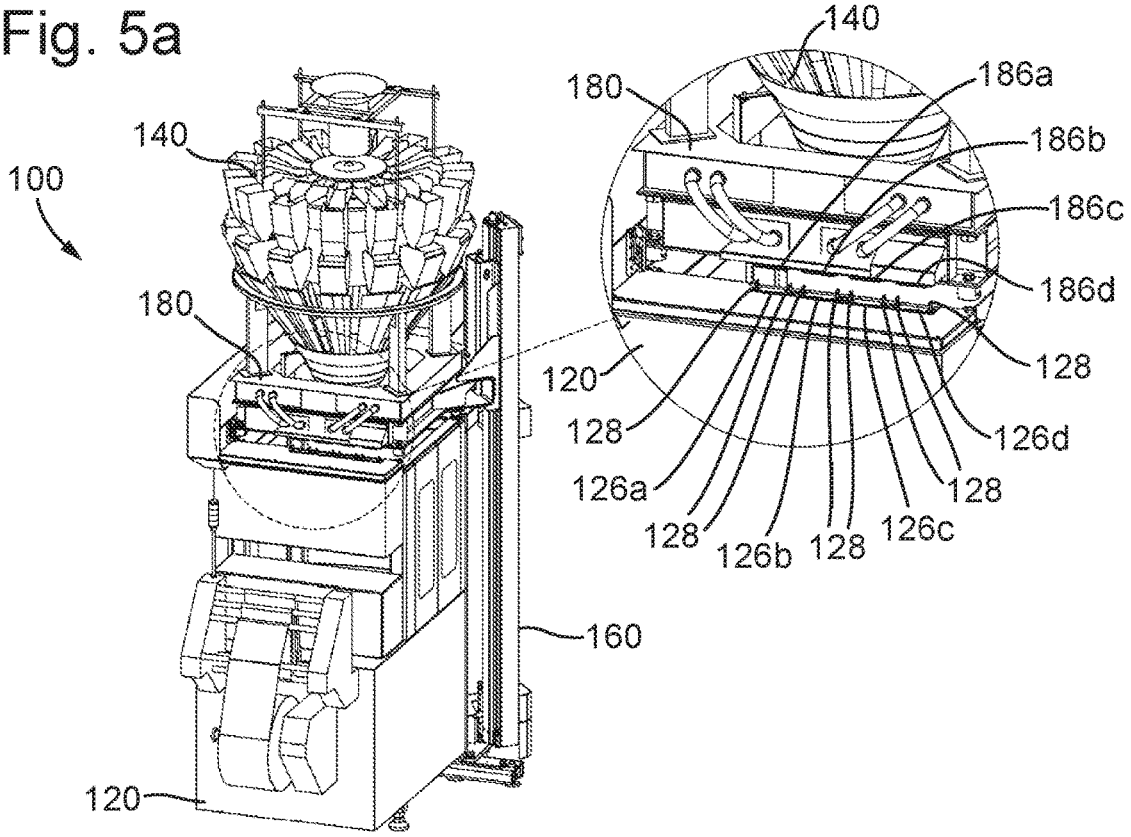
FIGS. 5(*a*) and 5(*b*) depict a projection view of a packaging system in accordance with the first embodiment of the present invention in further detail.
Figure 5B:
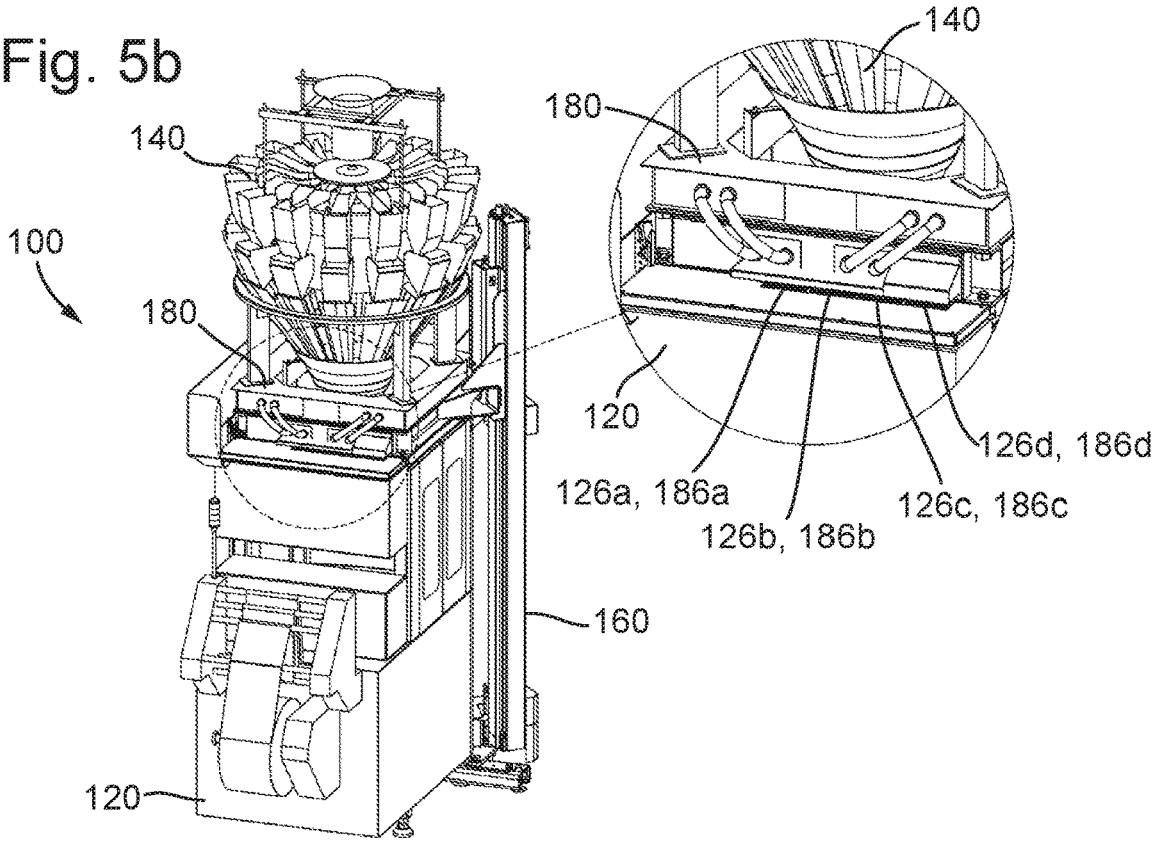

FIGS. 5(*a*) and 5(*b*) show further detail of the packaging system 100 when in the arrangements previously described with reference to FIGS. 4(*c*) and 4(*d*). These figures shall be used to describe the coupling between the feed device 140, sub frame 180 and packaging machine 120 in more detail.

The inset portion of FIG. 5(*a*) shows service connectors 126*a*, 126*b*, 126*c*, 126*d*, 186*a*, 186*b*, 186*c*, 186*d*, which transfer services between the packaging machine 120 and the feed device 140 via the sub frame 180, and a plurality of protrusions 128 which protect these service connectors 126*a*, 126*b*, 126*c*, 126*d*, 186*a*, 186*b*, 186*c*, 186*d*.

Female service connectors 126*a*, 126*b*, 126*c* and 126*d* are positioned on the top surface of the packaging machine 120. These respectively correspond to male service connectors 186*a*, 186*b*, 186*c* and 186*d* positioned on the underneath surface of sub frame 180, and engage together as shown in the inset portion of FIG. 5(*b*). The two sets of male and female service connectors are configured to engage and disengage with one another by raising or lowering the male or female service connectors relative to the other. Service connectors 126*a* and 186*a* transfer electrical power, service connectors 126*b* and 186*b* transfer fluids, service connectors 126*c* and 186*c* transfer gases, and service connectors 126*d* and 186*d* transfer control signals.

The plurality of protrusions 128 which protect the service connectors 126*a*, 126*b*, 126*c*, 126*d*, 186*a*, 186*b*, 186*c*, 186*d* by preventing the sub frame 180 (and the coupled feed device 140) contacting the packaging machine 120 if the two devices are incorrectly aligned. One protrusion is located on either side of each female service connectors 126*a*, 126*b*, 126*c* and 126*d* on the top surface of the packaging machine 120.

A corresponding plurality of recesses (not shown) are positioned within the underneath surface of the sub frame 180, such that one recess is located on either side of each male service connector 186*a*, 186*b*, 186*c* and 186*d*.

If the sub frame 180 and feed device 140 are lowered towards the packaging machine 120 when the sub frame 180 is correctly aligned the plurality of protrusions 128 will enter and engage (i.e. mesh with) the corresponding plurality of recesses, and the male service connectors 186*a*, 186*b*, 186*c*, 186*d* will engage (i.e. mesh with) the female service connectors 126*a*, 126*b*, 126*c*, 126*d*. Alternatively, and additionally, the service connectors 126*a*, 126*b*, 126*c*, 126*d*, 186*a*, 186*b*, 186*c*, 186*d* have a degree of "float" to accommodate minor misalignments between the feed device 140 and the packaging machine 120. The protrusions 128 may guide the service connectors 126*a*, 126*b*, 126*c*, 126*d*, 186*a*, 186*b*, 186*c*, 186*d* (i.e. cause them to move within the float) so that the male and female connectors 126*a*, 126*b*, 126*c*, 126*d*, 186*a*, 186*b*, 186*c*, 186*d* are in the correct location when they are brought together.

Figure 6A:
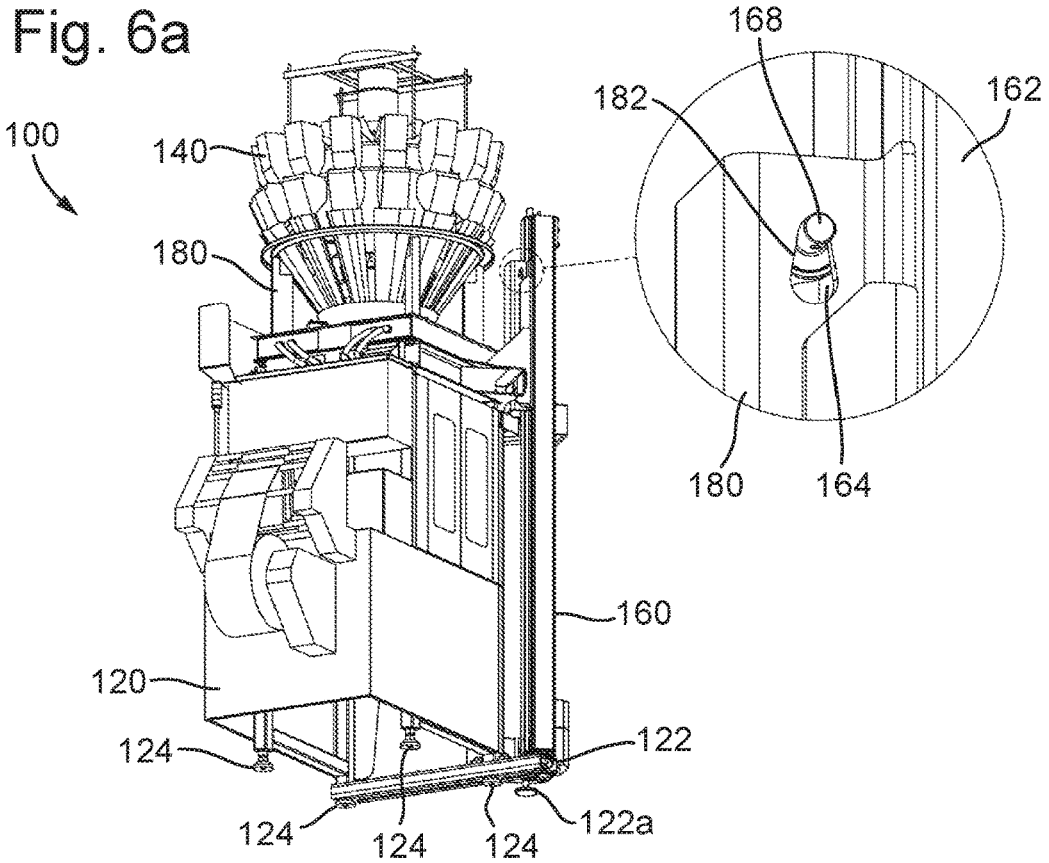
FIGS. 6(*a*) and 6(*b*) depict a projection view of a packaging system in accordance with the first embodiment of the present invention in further detail.
Figure 6B:
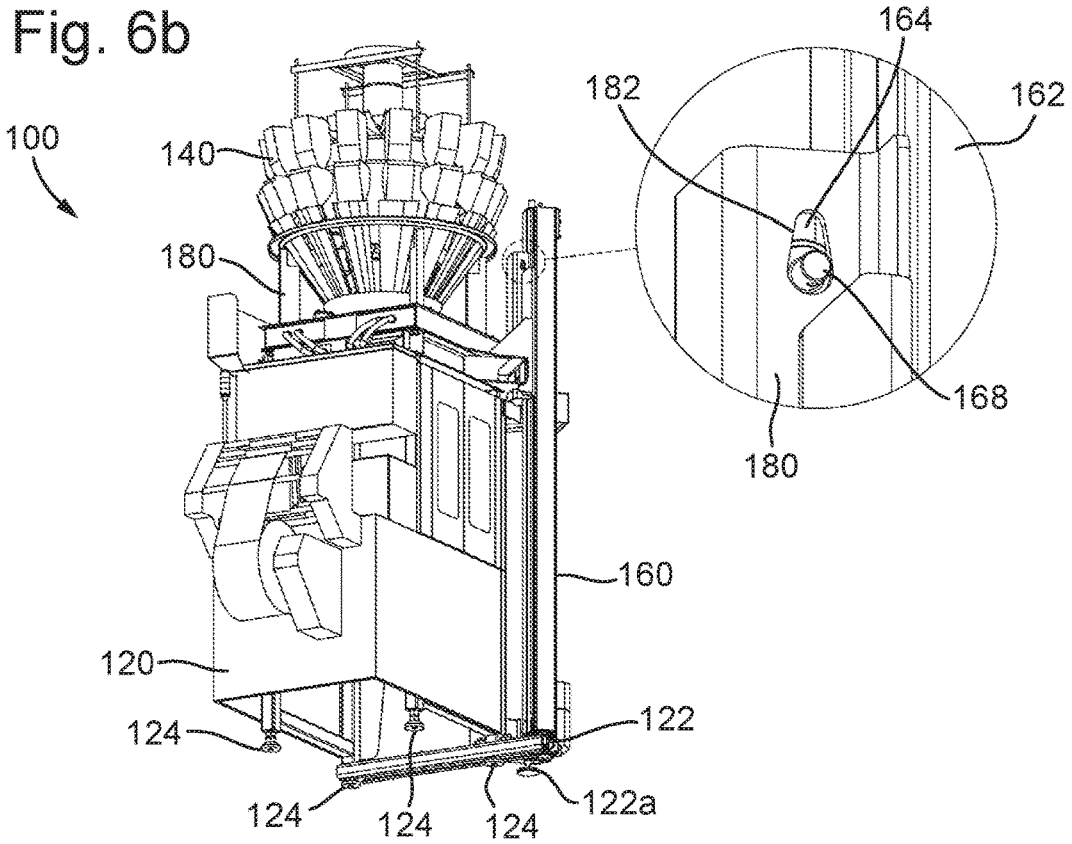
Figure 7B:
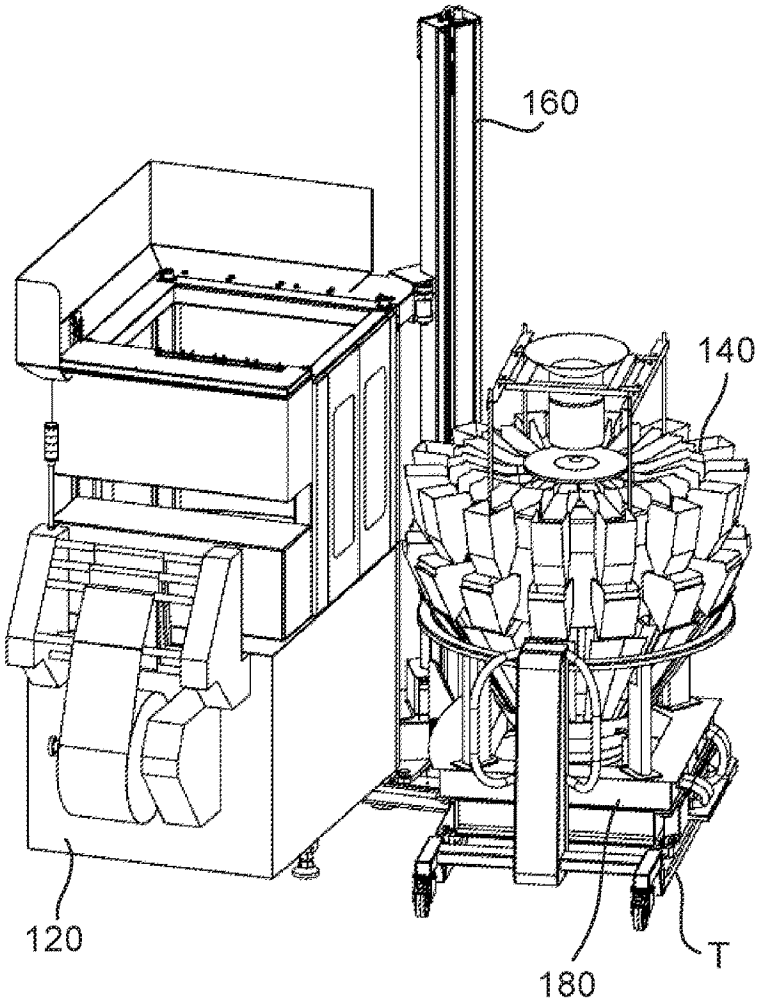
FIGS. 7(*a*) to 7(*c*) depict a projection view of a packaging system in accordance with the first embodiment of the present invention in further detail.
Figure 7A:
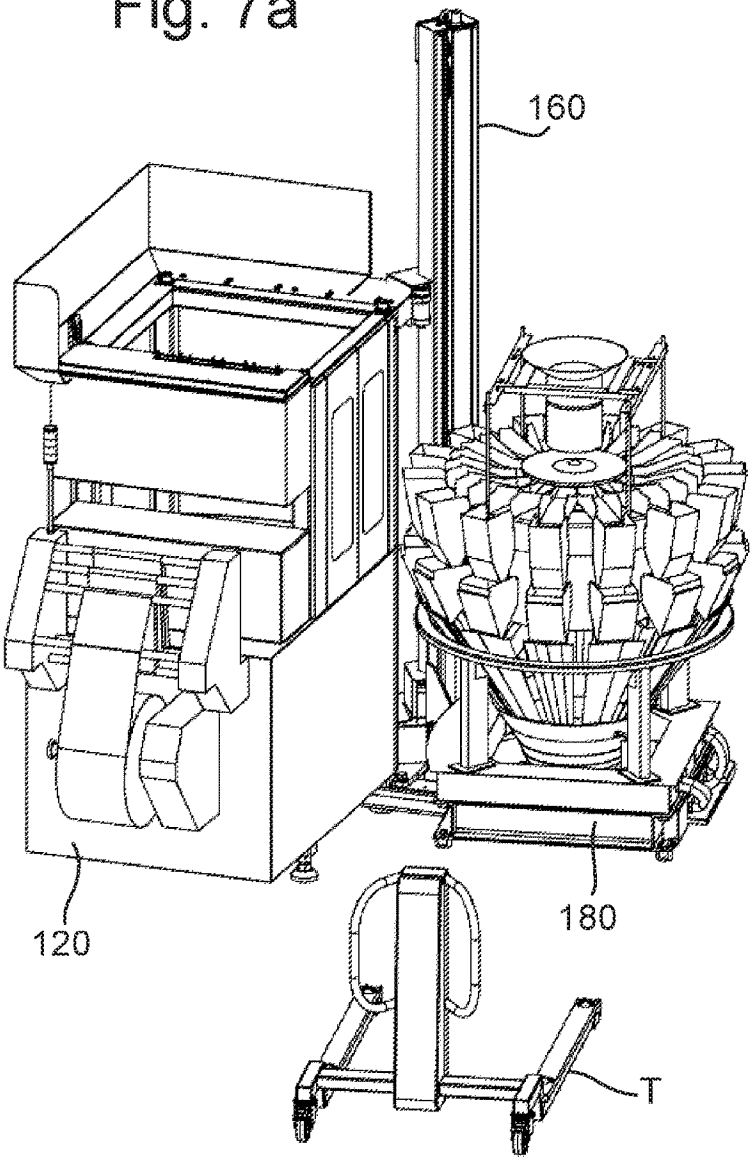

FIGS. 6(*a*) and 6(*b*) show additional detail of the packaging system 100. Specifically, the inset portions of these figures show in further detail the coupling between the sub frame 180 and the movable carriage 164. Both figures also provide a perspective view of the underneath of the packaging system 100, from which packaging machine supports 124 and lifting mechanism support 122*a* may be seen.

FIG. 6(*a*) shows the packaging system 100 in the arrangement corresponding to instant the sub frame 180 has contacted the packaging machine 120 during a mounting operation or the instance that the sub frame 180 is lifted from the packaging machine 120, such that the mass of the sub frame 120 and feed device 140 is supported by the lifting apparatus 160.

FIG. 6(*b*) shows the packaging system 100 in operation, where the sub frame 180 and feed device 140 are supported by the packaging machine 120.

In each case, sub frame 180 is connected to lifting frame 162 such that it is free to move along the longitudinal axis of the lifting frame 162 (i.e. in a substantially vertical direction). Similarly, movable carriage 164 may move longitudinally up and down the lifting frame 162 and is driven by a ball-screw actuator (not shown).

The movable carriage 164 is configured to receive a connecting pin 168. This connecting pin 168 extends through the movable carriage 164, and through two apertures 182 on either side of the portion of the sub frame 180 connecting to the lifting frame 162.

These apertures 182 are elongate, such that the connecting pin 168 may move longitudinally (i.e. vertically) within the apertures 182. The bottom of each aperture 182 is wider than the top of the aperture 182 and wider than the width of the connecting pin 168.

When the feed device 140 and sub frame 180 are supported by the movable carriage 164—as shown in FIG. 6*a* and at any point during the mounting, dismounting or maintenance procedure where the feed device 140 and sub frame 180—the sub frame 180 is suspended on connecting pin 168. This arrangement is shown in the inset portion of FIG. 6*a*. In this arrangement, the sub frame 180 (and the feed device 140) is constrained in the vertical direction by the connecting pin 168 and the position of the movable carriage 164. The connecting pin 168 is located at the top of apertures 182.

However, when the feed device 140 and sub frame 180 are lowered into contact with the packaging machine 120 (or any other external surface) by the movable carriage 164, the weight of the feed device and the sub frame 180 are transferred from the connecting pin 168 to the packaging machine 120. The sub frame 180 will therefore be supported by the packaging machine 120 as the movable carriage 164 continues to be lowered. Consequently, the connecting pin 168 moves vertically downwards relative to the apertures 182 within the sub frame 180, as shown in the inset portion of FIG. 6(*b*).

Because the bottom of the apertures 182 are wider than the width of connecting pin 168, the pin 168 does not contact the sides of the apertures and the movable carriage is mechanically isolated from the sub frame 180 and the feed device 140. Consequently, the sub frame 180 is no longer constrained in the vertical direction by the lifting apparatus 160 and is decoupled or isolated from the lifting apparatus in at least the vertical direction (i.e. the lifting apparatus is decoupled in a linear degree of freedom).

This arrangement of the connecting pin 168 of the lifting apparatus 160 relative to the apertures 182 within the sub frame 180 is hereafter termed the "clearance position".

By decoupling or isolating the sub frame 180 from the lifting apparatus 160 in a vertical degree of freedom in this clearance position, the vibrations or stresses transmitted from the sub frame 180 to the lifting apparatus 160 during operation are significantly reduced. This decoupling ensures the accuracy of the feed device. In particular, by reducing the vibrations transmitted to the weighing and portioning components of the feed device the accuracy of weighing and portioning is increased. Additionally, the reduction of vibration and stresses transmitted between the components of the system may reduce the risk of damage or fatigue during operation of the feed device 140 and/or the packaging machine 120, thereby extending the life of the packaging system 100.

FIGS. 6(*a*) and 6(*b*) also show the packaging machine supports 124 and lifting mechanism support 122*a* of packaging system 100.

The four packaging machine supports 124 are disposed near the four corners of the base of packaging machine 120. Each is formed as a flat foot, i.e. each comprises a projecting part which extends below the packaging machine 120 and a broad, level surface at the end of the projecting part furthest from the packaging machine 120. In use, these packaging machine supports 124 contact the surface on which the packaging machine 120 is placed and transmit mechanical forces between the packaging machine 120 and this surface.

The lifting mechanism support 122*a* extends downwards through the cantilever 122 from the base of lifting mechanism 160. The lifting mechanism support 122*a* is close to the substantially vertical plane of the lifting frame 162 and, as such, is "outboard" from the packaging machine, i.e. it is laterally spaced from the extend of the packaging device 120. Again, the support comprises a projecting part which extends below the lifting mechanism 160 and a broad, level surface at the end of the projecting part furthest from the lifting mechanism 160. In use the lifting mechanism support 122*a* will contact the surface on which the packaging system 100 is placed and will transmit mechanical forces from the cantilever 122 to this surface.

Therefore, when the feed device 140 is supported by the lifting mechanism 160 (i.e. the connecting pin 168 is in contact with sub frame 180) a portion of the weight of the feed device 140 will be transmitted to the surface which the packaging system 100 is positioned on via the lifting mechanism support 122*a*. This increases the stability of the packaging system 100 when the feed device is lifted. However, given the high mass of conventional feed devices (for instance, CCWs typically weigh 500 to 600 kg) the majority of the mass of the feed device 140 is counterbalanced across cantilever 122 by the mass of the packaging machine 120.

Cantilever 122 and lifting mechanism support 122*a* effectively shift the balance point of the cantilevered mass. The position of lifting mechanism support 122*a* can be considered the pivot at the centre of a seesaw. Therefore, the outboard position of lifting mechanism support 122*a* increases the amount of inboard mass (i.e. mass nearer the packaging machine 120 than the pivot position provided by lifting mechanism support 122*a*), while reducing the amount of outboard mass (mass which is further from the packaging machine 120 than the pivot point created by lifting mechanism support 122*a*). This increases the mechanical advantage of the mass of the packing machine 120, as it is required to counterbalance a reduced mass. This results in a system which is more stable and safer whilst the feed device 140 is raised and lowered.

FIGS. 7(*a*), 7(*b*) and 7(*c*) illustrate how a feed device 140 may be removed from the packaging system 100 using trolley T.

FIG. 7(*a*) shows the packaging system 100 in an arrangement wherein the feed device 140 has been decoupled and dismounted from packaging machine 120. The feed device 140 is supported by the lifting apparatus 160 adjacent to the packaging machine 120.

To remove the feed device 140, an operator places a trolley configured to receive the sub frame 180 and the feed device 140 underneath the sub frame 180 and the feed device 140. The lifting apparatus 160 is then operated to lower the sub frame 180 and feed device 140 onto the trolley T by lowering the movable carriage 164.

As the sub frame 180 contacts the trolley the weight of the sub frame 180 and feed device 140 are transferred from the lifting apparatus 160 to the trolley T. The movable carriage is lowered further and the connecting pin 168 achieves the clearance position discussed above in reference to FIGS. 6(*a*) and (*b*). This arrangement is shown in FIG. 8(*b*).

Figure 8:
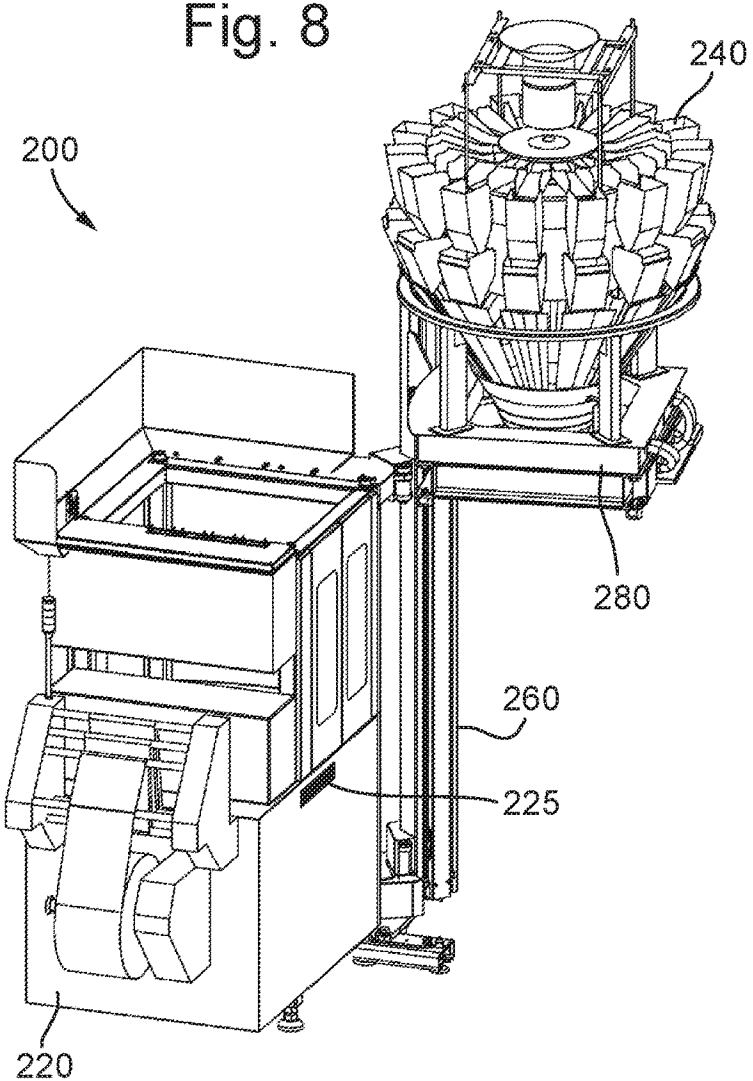
FIG. 8 depicts a projection view of a packaging system in accordance with a first embodiment of the present invention.
Figure 7C:
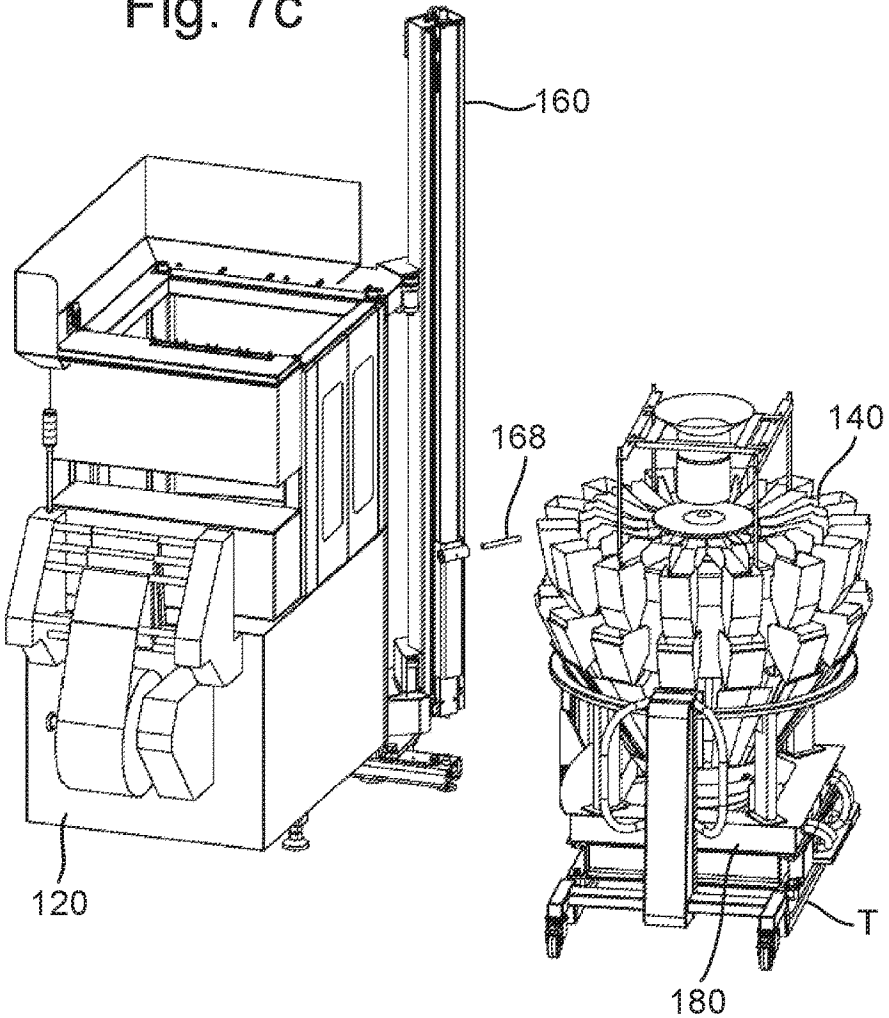

As the connecting pin 168 is in the clearance position the pin may be removed by an operator and the feed device 140 and sub frame 180 may be removed by the operator on the trolley T, as shown in FIG. 8(*c*).

To attach or install a feed device 140 to the packaging system 100 this process discussed above is reversed. The feed device 140 and sub frame 180 are brought into contact with the movable carriage 164 of the lifting apparatus 160, the connecting pin 168 is inserted, and the movable carriage 168 is raised to lift the feed device 140 and sub frame 180 from the trolley T. The feed device 140 may then be mounted and coupled to the packaging machine 120 as discussed above.

In preferred methods of operating the packaging system 100 the raising of the feed device 140 during installation and the lowering of the feed device 140 during removal are both two stage processes.

When the feed device is mounted to the packaging system 100 preferably the movable carriage 168 is initially raised at a slow speed, and under operator control (although this is not essential), to ensure that the feed device 140 has been correctly coupled to the lifting apparatus 160. Once the coupling has been inspected by an operator the feed device 140 may be raised at a relatively higher speed to reduce the time required to couple a feed device 140 to the packaging machine.

Similarly, when a feed device is removed from the packaging system 100 the feed device is lowered from a position above the packaging machine 140 at a relatively high speed. However, the feed device 140 is preferably lowered onto trolley T at a relatively slow speed, and under operator control (although this is not essential to ensure that the feed device 140 has been correctly located on trolley T.

These two step processes increase the safety and reduce the risk of damage to the system 100 during the mounting and dismounting process.

The safety of packaging systems may be further improved using sensors able to which are configured to detect the presence of foreign objects (e.g. people, other machinery, and consumables) in the path of the feed device 140 during translation, raising or lowering. If a sensor does detect a foreign object the movement of the feed device 140 may be slowed or stopped.

Suitable sensors may include a laser sensor, such as a laser area scanner, a light gate, a visible light sensor or a UV sensor. These sensors may be mounted on one or more components of the packaging systems including the packaging machine 120, feed device 140, lifting apparatus 160 and sub frame 180.

For instance, as shown in FIG. 8 (which illustrates a packaging system in accordance with the first embodiment of the invention in further detail), a laser area sensor 125 is positioned on the side of packaging machine 120, within packaging system 100. The packaging system further comprises feed device 140, lifting apparatus 160 and sub frame 280 and may comprise any of the features and components discussed above in reference to FIGS. 1 to 7.

Laser sensor 125 is positioned near the base of packaging machine 120. Accordingly, it is located near to the surface that the packaging machine 120 is placed on when in use. Specifically, laser sensor 125 is positioned approximately 150 mm above the bottom of packaging machine 120 and the surface on which the packaging machine 120 stands.

This positioning ensures that the laser sensor 125 has good line of sight below the feed device 140 during typical raising and lowering operations. In other words, the path of the feed device 140 is not obscured from the laser sensor 125 and as such the laser sensor 125 may detect any foreign objects.

Where a trolley (such as the trolley T shown in FIGS. 7*a* to 7*c*) is used to remove or install a feed device 140. The trolley T will be positioned between the feed device 140 and the laser sensor 125 and therefore obscure or block the feed device 140 from the laser sensor 125. In this arrangement the system 100 may be prevented from automatically raising or lowering the feed device 140 as the trolley is detected by the laser sensor 125. However, the feed device 140 may still be raised and lowered (e.g. onto and off of the trolley) under manual control. The raising and lowering of the feed device 140 under manual control may be performed at a reduced speed in comparison to other raising and lowering operations. These features ensure the safety of the operators and the machinery.

Figure 9A:
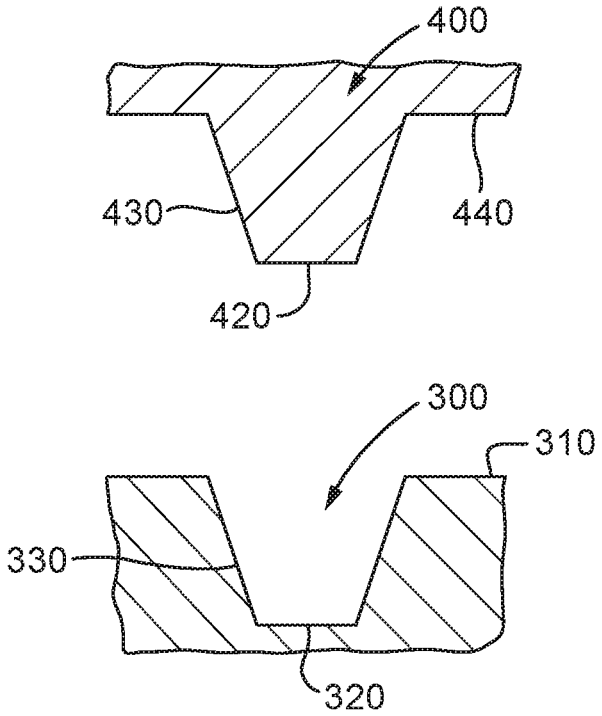
FIGS. 9(*a*) and 9(*b*) depict cross sections of protrusions and recesses suitable for use within packaging systems in accordance with the present invention.

FIGS. 9(*a*) and 9(*b*) show cross sections of recesses 300 and protrusions 400 suitable for use within packaging systems in accordance with the present invention.

As discussed above, preferably a feed device or a sub frame and a packaging machine are provided with corresponding recesses and protrusions, such that the recesses and protrusions will only engage when the feed device and the packaging machine are correctly aligned and help ensure that the feed device is correctly retained in contact with the packaging machine.

These protrusions 300 and recesses 400 may be positioned on either side of service connectors which couple the feed device to the packaging machine. Or be positioned at any other location on the surfaces of the packaging machine and either the feed device or sub frame which are in contact when the system is in use.

FIGS. 9(*a*) and 9(*b*) show examples of such corresponding recesses 300 and protrusions 400 which will engage when correctly aligned. Additionally each set of recesses 30 and protrusions 400 will additionally correct small misalignments between a feed device and a packaging machine as the feed device is brought into contact with the packaging machine.

Each recess 300 extends into a surface 310 of either the packaging machine, or the feed device or the sub frame configured to connect to the feed device. The recesses 300 are defined by a base surface 320 and recess sides 330. In both cases the recess sides 330 narrow from the surface 310 to the base surface 320 of the recess 300. In both FIGS. 9(*a*) and 9(*b*) this narrowing is continuous, and the width of the recess is tapered. Alternatively, the narrowing may be discontinuous and the recess sides 330 may be stepped.

Each protrusion 400 extends from a surface 410 of either the packaging machine, or the feed device or the sub frame configured to connect to the feed device. The protrusions 400 are defined by a top surface 420 and protrusion sides 430. In both cases the protrusion sides 430 narrow from the surface 410 to the top surface 420 of the recess 400. In FIG. 9(*a*) the narrowing of the protrusion 400 is continuous and the protrusion is formed as a truncated cone, i.e. the protrusion 400 is tapered. Whilst the protrusion 400 shown in FIG. 9(*b*) discontinuously narrows, and its shape is formed of a truncated cone positioned on the top of a cylinder.

Consequently, the recesses 300 and protrusions 400 together may be termed as a "cup and cone", and will mechanically centre, i.e. align to each other, when they are brought together.

When the recesses 300 and protrusions 400 of FIGS. 9(*a*) and 9(*b*) are brought into contact along a first direction when there is a small misalignment the recess sides 330 and the protrusion sides 430 will cause the recess 300 and protrusion 400 (and the devices to which the recess 300 and protrusion are mounted) to move laterally to the first direction of the movement. This will cause the protrusion 400 and recess 300 to align or centre relative to one another.

To achieve this effect the "small misalignment" must be less than the largest of the difference between the difference in thickness between the protrusion top 420 and the width of the protrusion 400 at surface 410 and the difference in thickness between the recess base 320 and the width of the recess 300 at surface 310.

Figure 9B:
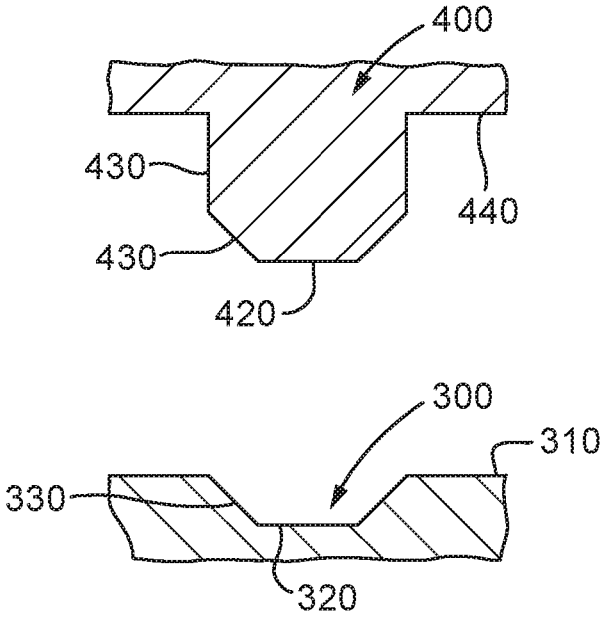

It is noted that a similar effect may also be achieved where only one of the recess sides 340 or protrusion sides 430 narrows or tapers. Additionally, the recess and protrusion may be of different heights, as shown in FIG. 9*b*.

The invention claimed is:

1. A packaging system comprising:

a feed device;

a packaging machine configured to detachably couple to the feed device;

a lifting apparatus comprising a lifting frame mechanically coupled to the packaging machine, and configured to couple with the feed device;

wherein the lifting frame is configured to translate, raise and lower the feed device relative to the packaging machine;

wherein the mass of the packaging machine acts to counterbalance at least a portion of the mass of the feed device whilst the feed device is being translated, raised or lowered relative to the packaging machine; and wherein the packaging machine comprises at least one: bag maker; tray sealer; cartonising machine; or thermoformer.

2. The system according to claim 1, wherein the lifting apparatus is configured to detachably couple with the feed device.

3. The system according to claim 1, wherein the lifting frame may be rotated about a substantially vertical axis, such that, when the feed device is coupled to the lifting frame, the feed device may be rotated about the substantially vertical axis, and/or, wherein the lifting frame may be rotated about a substantially horizontal axis, such that, when the feed device is coupled to the lifting frame, the feed device may be simultaneously raised or lowered in a vertical plane and translated in a horizontal plane relative to the packaging machine.

4. The system according to claim 1, wherein the feed device comprises a grader, a batcher, a volumetric feeder or a computer controlled weigher (CCW) such as: a combination weigher; a multihead weigher; a screw feeder weigher; a cut gate weigher; a linear weigher; or a mix weigher.

5. The system according to claim 1, wherein the mass of the packaging machine acts to counterbalance at least 50% of the mass of the feed device whilst the feed device is being raised, lowered or translated relative to the packaging machine.

6. The system according to claim 1, wherein the lifting frame is mechanically coupled to the packaging machine by a cantilever.

7. The system according to claim 1, further comprising at least one sensor able to detect the presence of foreign object in the path of the feed device.

8. The system according to claim 7, wherein said at least one sensor is a laser sensor.

9. The system according to claim 1, wherein the packaging machine further comprises a first service connector, the first service connector configured to engage with a corresponding second service connector when the packaging machine and the feed device are coupled.

10. The system according to claim 9, wherein the service connectors transfer at least one of electrical power, fluids, gases, or control signals between the packaging machine and the feed device.

11. The system according to claim 9, wherein the service connectors may be disengaged from one another by raising the feed device away from the packaging machine, and/or the service connectors may be engaged together by lowering the feed device towards the packaging machine.

12. The system according to claim 1, further comprising:

a recess disposed on a first surface and a corresponding protrusion disposed on a second surface, wherein the protrusion engages the recess when the packaging machine and feed device are coupled.

13. The system according to claim 12 wherein the packing machine further comprises a first service connector, the first service connector configured to engage with a corresponding second service connector when the packaging machine and the feed device are coupled, wherein the protrusion extends further from the second surface than the first service connector or the second service connector, such that during the coupling of the feed device and the packaging machine the protrusion will enter the recess before the first and second service connectors engage.

14. The system according to claim 12, wherein:

the recess comprises a base surface which is inset within the first surface, and at least one recess side provided between the base surface and the first surface;

wherein said at least one recess side continuously or discontinuously narrows from the first surface to the base surface of the recess; and/or, wherein:

the protrusion comprises a top surface which is raised from the second surface, and at least one protrusion side provided between the top and the second surface;

wherein said at least one protrusion side continuously or discontinuously narrows from the second surface to the top surface of the recess.

15. The system according to claim 1, wherein the feed device is configured to feed food or drink to the packaging machine.

16. The system according to claim 1, wherein the packaging machine is configured to package food or drink received from the feed device.

17. A method of operating a system to install a feed device to a packaging machine, the system comprising:

a packaging machine configured to detachably couple to the feed device;

a lifting apparatus comprising a lifting frame mechanically coupled to the packaging machine, and configured to couple with the feed device;

wherein the lifting frame is configured to translate, raise and lower the feed device relative to the packaging machine;

wherein the mass of the packaging machine acts to counterbalance at least a portion of the mass of the feed device whilst the feed device is being translated, raised or lowered relative to the packaging machine; and wherein the packaging machine comprises at least one: bag maker; tray sealer; cartonising machine; or thermoformer;

the method comprising the steps of:

positioning the feed device adjacent to the packaging machine;

coupling the feed device to a lifting apparatus;

operating the lifting apparatus to raise and translate the feed device relative to the packaging machine;

operating the lifting apparatus to lower the feed device, such that feed device is coupled to the packaging machine;

wherein the mass of the packaging machine acts to counterbalance at least a portion of the mass of the feed device whilst the feed device is being raised, lowered or translated relative to the packaging machine.

18. The method according to claim 17, wherein operating the lifting apparatus to raise the feed device comprises a first raising step where the feed device is raised at a relatively low speed and a second raising step where the feed device is raised at a relatively high speed.

19. A method of operating a system to remove a feed device from a packaging machine, the system comprising:

a packaging machine configured to detachably couple to the feed device;

a lifting apparatus comprising a lifting frame mechanically coupled to the packaging machine, and configured to couple with the feed device;

wherein the lifting frame is configured to translate, raise and lower the feed device relative to the packaging machine;

wherein the mass of the packaging machine acts to counterbalance at least a portion of the mass of the feed device whilst the feed device is being translated, raised or lowered relative to the packaging machine; and wherein the packaging machine comprises at least one: bag maker; tray sealer; cartonising machine; or thermoformer;

the method comprising the steps of:

coupling the feed device to a lifting apparatus;

operating the lifting apparatus to raise the feed device, such that feed device is decoupled from the packaging machine;

operating the lifting apparatus to translate and lower the feed device relative to the packaging machine;

decoupling the feed device from the lifting apparatus;

wherein the mass of the packaging machine acts to counterbalance at least a portion of the mass of the feed device whilst the feed device is being raised, lowered or translated relative to the packaging machine.

20. The method of claim 19, wherein operating the lifting apparatus to lower the feed device comprises a first lowering step where the feed device is lowered at a relatively high speed and a second lowering step where the feed device is lowered at a relatively low speed.

* * * * *